US008636606B2

(12) United States Patent
Sato

(10) Patent No.: US 8,636,606 B2
(45) Date of Patent: Jan. 28, 2014

(54) GOLF CLUB AND METHOD OF ADJUSTING PROPERTIES THEREOF

(75) Inventor: Fumiaki Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 293 days.

(21) Appl. No.: 13/080,918

(22) Filed: Apr. 6, 2011

(65) Prior Publication Data

US 2011/0250984 A1 Oct. 13, 2011

(30) Foreign Application Priority Data

Apr. 8, 2010 (JP) ..... 2010-089540
Apr. 23, 2010 (JP) ..... 2010-099966

(51) Int. Cl.
*A63B 53/02* (2006.01)

(52) U.S. Cl.
USPC ..... 473/307; 473/288; 473/309; 473/335; 473/248

(58) Field of Classification Search
USPC ..... 473/244–248, 288, 307, 309–310, 312, 473/334–339, 345–346
See application file for complete search history.

(56) References Cited

U.S. PATENT DOCUMENTS 3,692,306 A * 9/1972 Glover ..... 473/306
4,502,687 A * 3/1985 Kochevar ..... 473/346
4,803,023 A * 2/1989 Enomoto et al. ..... 264/45.4
5,275,408 A * 1/1994 Desbiolles et al. ..... 473/312
5,776,011 A * 7/1998 Su et al. ..... 473/345
6,001,027 A * 12/1999 Hansberger ..... 473/306
6,019,687 A * 2/2000 Blowers ..... 473/326
6,033,321 A * 3/2000 Yamamoto ..... 473/338
6,203,448 B1 * 3/2001 Yamamoto ..... 473/338
6,352,483 B1 * 3/2002 Okoshi ..... 473/324
6,379,265 B1 * 4/2002 Hirakawa et al. ..... 473/338
6,478,691 B2 * 11/2002 Okoshi ..... 473/324
6,524,198 B2 * 2/2003 Takeda ..... 473/338
6,769,996 B2 * 8/2004 Tseng ..... 473/306
6,773,360 B2 * 8/2004 Willett et al. ..... 473/334
6,855,067 B2 * 2/2005 Solheim et al. ..... 473/310
6,884,179 B2 * 4/2005 Hoffman et al. ..... 473/312
7,470,201 B2 * 12/2008 Nakahara et al. ..... 473/345
7,621,821 B2 * 11/2009 Tsai et al. ..... 473/306
7,931,542 B2 * 4/2011 Kusumoto ..... 473/288

(Continued)

FOREIGN PATENT DOCUMENTS

JP 371768 U 11/1949
JP 64-056972 A 4/1989

(Continued)

OTHER PUBLICATIONS

Japanese Office Action issued Dec. 3, 2013; in corresponding Japanese Application No. 2010-099966.

(Continued)

*Primary Examiner* — Stephen L. Blau
(74) *Attorney, Agent, or Firm* — Sughrue Mion, PLLC

(57) ABSTRACT

A golf club includes: a hosel of a head to which a leading end of a shaft is attached; a weight material for adjusting weight being provided in a lower end portion of a hosel hole; and a communication opening which communicates the lower end portion of the hosel hole with an inside of the head, wherein the weight material is detachably screwed into the communication opening.

6 Claims, 20 Drawing Sheets

(56) References Cited

U.S. PATENT DOCUMENTS

| | | | | |
|---|---|---|---|---|
| 8,088,023 | B2 * | 1/2012 | Kubota | 473/335 |
| 2002/0034984 | A1 * | 3/2002 | Takeda | 473/305 |
| 2002/0077193 | A1 * | 6/2002 | Takeda | 473/305 |
| 2002/0137575 | A1 * | 9/2002 | Tseng | 473/305 |
| 2003/0148818 | A1 * | 8/2003 | Myrhum et al. | 473/290 |
| 2004/0018886 | A1 | 1/2004 | Burrows | |
| 2004/0067799 | A1 * | 4/2004 | Yamamoto | 473/324 |
| 2004/0132540 | A1 * | 7/2004 | Tseng | 473/306 |
| 2007/0155529 | A1 * | 7/2007 | Voges | 473/290 |
| 2009/0197695 | A1 | 8/2009 | Tsai et al. | |
| 2010/0022323 | A1 | 1/2010 | Thomas et al. | |
| 2010/0323815 | A1 * | 12/2010 | Bezilla et al. | 473/335 |

FOREIGN PATENT DOCUMENTS

| | | | |
|---|---|---|---|
| JP | 4-7863 | U | 1/1992 |
| JP | 9-087708 | A | 3/1997 |
| JP | 9-164227 | A | 6/1997 |
| JP | 2000-84123 | A | 3/2000 |
| JP | 2001-104523 | A | 4/2001 |
| JP | 2001-112893 | A | 4/2001 |
| JP | 2001-170225 | A | 6/2001 |
| JP | 2006-042950 | A | 2/2006 |
| JP | 2006-42951 | A | 2/2006 |
| JP | 2009-50676 | A | 3/2009 |
| JP | 2009-254449 | A | 11/2009 |
| JP | 2009-268597 | A | 11/2009 |
| JP | 2010-057554 | A | 3/2010 |

OTHER PUBLICATIONS

Office Action dated Nov. 12, 2013 issued by the Japanese Patent Office in counterpart Japanese Patent Application No. 2010-089540.

* cited by examiner

GOLF CLUB AND METHOD OF ADJUSTING PROPERTIES THEREOF

BACKGROUND

1. Field of the Invention

The present invention relates to a golf club, and particularly to a golf club with a shaft which can be easily replaced. In addition, the present invention relates to a method of adjusting the properties of this golf club and to a method of replacing the shaft.

2. Description of the Related Art

A golf club is made by attaching a head to the leading end portion of a shaft. The shaft is provided with a grip attached to the base end portion thereof.

According to a conventional general golf club head, a hosel hole is directly provided in the head, and the shaft is inserted into the hosel hole and bonded by adhesive. In addition, an epoxy adhesive is generally used as the adhesive. When the shaft is replaced, the shaft can be pulled out by heating the hosel portion and destroying the composition of epoxy resin hardener.

Incidentally, JP-A-H9-87708 and JP-A-2001-112893 disclose that a weight material for adjusting the balance is provided in the lower end portion in the hosel hole in order to adjust the balance of the head.

In addition, JP-A-2009-254449 and JP-A-2010-57554 respectively disclose a golf club with a replaceable shaft, in which a shaft case is bonded to the leading end of the shaft, and this shaft case is inserted into the hosel hole and fixed with a screw member.

JP-A-2001-170225 discloses that noise is reduced by arranging agglutinant in the head to cause floating matter to adhere thereto.

However, according to JP-A-H9-87708 and JP-A-2001-112893, the weight material is moved and produces abnormal noise. Further, since the shaft has to be detached from the head when the weight material is replaced, it is difficult to replace the weight material.

Further, JP-A-2010-57554 discloses a golf club with a head attached to the leading end of the shaft, in which a substantially cylindrical shaft case is bonded to the leading end of the shaft, the shaft case is inserted into the hosel from the upper end side of the hosel in the head, and the shaft case is fixed to the hosel by a ring-shaped screw member which is fitted onto the shaft case and detachably screwed into the upper end side of the hosel. The golf club shown in FIGS. 21 to 26 of this patent document is configured such that a small diameter portion is provided on the outer circumferential surface of the shaft case in the middle of the tube axial center line direction, the lower side than the small diameter portion forms a large diameter portion, a lower stepped surface is provided between the small diameter portion and the large diameter portion, the upper side than the small diameter portion of the shaft case forms an enlarged diameter portion, an upper stepped surface is provided between the small diameter portion and the enlarged diameter portion, the head is provided with a head main body and the hosel bonded to the head main body, a female screw is carved in the inner circumferential surface of the hosel on the upper end side, a male screw is provided on the outer circumferential surface of the screw member, the screw member is screwed into the hosel by screwing the male screw into the female screw of the hosel, the shaft case is fixed by pressing downward the lower stepped surface by the lower end surface of the screw member, and the shaft case can be pulled out from the hosel by pressing upward the upper stepped surface by the upper end surface of the screw member.

SUMMARY

According to an aspect of the invention, there is provided a golf club including: a hosel of a head to which a leading end of a shaft is attached; a weight material for adjusting weight being provided in a lower end portion of a hosel hole; and a communication opening which communicates the lower end portion of the hosel hole with an inside of the head, wherein the weight material is detachably screwed into the communication opening.

The leading end of the shaft may be inserted into and bonded to a shaft inserting hole of a substantially cylindrical shaft case including the shaft inserting hole.

The shaft case may be inserted into the hosel hole.

An axial center of the shaft inserting hole may be obliquely directed with respect to an axial center of the hosel hole.

The shaft case may be fixed to the hosel with a ring-shaped screw member which fits onto the shaft case and is detachably screwed into the hosel on the upper end side.

The screw member may be arranged in an outer circumference of the shaft case in the non-contact state with respect to the shaft.

At least a part of an inner circumferential surface of the hosel hole and at least a part of the outer circumferential surface of the shaft case respectively may have a sectional shape in the direction perpendicular to the axial center line, which is a multiangular shape with 3 or more sides.

A convex portion may be provided on the outer circumferential surface of the shaft case in the middle of its axial center line direction.

A female screw may be carved on the inner circumferential surface of the hosel hole on the upper end side.

A male screw may be provided on the outer circumferential surface of the screw member.

The screw member may be fixed to the hosel hole by screwing the male screw into the female screw of the hosel hole.

The shaft case may be fixed by pressing the convex portion downward by the lower end surface of the screw member.

An elastic body may be interposed on the lower side of the screw member.

The shaft may be inserted into the shaft inserting hole of the shaft case and bonded with adhesive.

A lower end side of the shaft case may have a tapered multiangular sectional shape.

The elastic body may be interposed between a lower end side of the shaft case and an inner surface of the hosel hole.

Agglutinant supplied through the communication opening may be adhered to a part of the inner surface of the head.

According to another aspect of the invention, there is provided a method of adjusting the properties of the above golf club including: rotating a shaft case about its axial center to change the direction after the screw member is rotated and detached; and fixing the shaft case to the hosel hole thereafter by screwing the screw member into the hosel hole.

The weight material may be replaced with another weight material with different weight or detached.

According to the golf club and the method of adjusting the properties thereof of the present invention, the weight material cannot be seen from outside since the weight material is provided in the lower end portion in the hosel, and therefore, a good appearance can be achieved. In addition, since the weight material is screwed into a communication opening in the lower end portion of the hosel hole, the weight material does not move.

According to the above aspects of the present invention, the shaft case can be pulled out from the hosel hole by loosening and unscrewing the screw member. Therefore, it is possible to easily replace and detach the weight material. In addition, the shaft case is removed from the hosel hole, then slightly rotated to change its direction, and inserted again into the hosel hole, and the screw member is screwed thereto. This shaft case has a shaft inserting hole with an axial center which is obliquely directed (for example, in an obliquely intersecting direction) with respect to the axial center of the hosel hole, and therefore, the shaft attaching direction with respect to the golf club head is changed, and a lie angle and a slice angle are changed, when the direction of the shaft case is changed in the above manner.

Accordingly, it is possible to adjust only the lie angle or the slice angle with the use of a golf club formed from the exact same shaft and head.

It is possible to obtain a golf club which is different only in the shaft by preparing a shaft case which is completely the same type as the shaft case, bonding a shaft with different properties to this shaft case to form a shaft case and shaft connected body, replacing the head shaft case and shaft connected body, which has been attached hitherto, with this shaft case and shaft connected body, and attaching the shaft case and shaft connected body to the head. It is also applicable that the shaft cases having shaft inserting holes with different inclination angles and the shafts with the same properties are used, or shafts with different properties may also be used.

In recent years, a system has been developed by which a golfer finds a golf club matching himself/herself with the use of a computer and a high speed camera in order to find a golf club suitable for his/her technique. Such a system is a system for finding a golf club basically by trying and comparing individual commercially available clubs based on a head speed, a launch angle, and the like.

On the contrary, according to the above golf club, it is possible to feel the difference only in the shaft by changing only the shaft with respect to the same head, and it is also possible to easily feel the difference in the ball flying properties (the launch angle and the spin) of the hit ball by changing only the positional relation between the same shaft and the same head to change the center of gravity distance and the progression. In addition, it is also possible to change the shaft attaching direction with respect to the head in order to replace the shaft in accordance with the condition of the player on that day or to adjust the lie angle and the slice angle with the same shaft.

According to the golf club, it is possible to pull out the shaft case from the hosel hole by loosening and unscrewing the screw member. The shaft can be replaced by inserting a new shaft case and shaft connected body, in which the shaft case is attached to the shaft in advance, into this hosel and screwing the screw member. According to this method of replacing the shaft, it is possible to omit the troubling effort and the time in the conventional method in which the shaft is detached by heating and destroying the composition of the adhesive and attaching a new shaft again with the adhesive. Accordingly, a golfer can find a proper golf club at a golf shop or the like very easily since it is possible to detach the shaft from the head of a golf club with which a trial shot has just been made, attach another shaft with different properties to this head, and immediately perform another trial shot. In addition, it is possible to evaluate the shaft without considering the individual variability of the head. Moreover, it is also possible to easily change the lie angle and the slice angle with the same head and the same shaft.

According to the above golf club, the shaft case is fixedly attached to the hosel of the shaft case since the shaft case is inserted into the hosel and fixed with the screw member.

In addition, the screw member does not slide on the shaft even when the screw member is rotated, and the shaft is not damaged, since the screw member is positioned in the outer circumference of the shaft case and is in a non-contact state with respect to the shaft.

According to still another aspect of the invention, there is provided a golf club with a head attached to a leading end of a shaft, a shaft case with a substantially cylindrical shape being bonded to the leading end of the shaft, the shaft case being inserted into a hosel from the upper end side of the hosel in the head, the shaft case being fixed to the hosel by a ring-shaped screw member which is fitted onto the shaft case and screwed into the upper end side of the hosel, wherein the screw member includes a plurality of split screw members arranged so as to interpose the shaft case.

The split screw members may be two half-split screw members.

A small diameter portion may be provided on the outer circumferential surface of the shaft case in the middle of a tube axial center line direction, and the screw member may be arranged in the small diameter portion.

The lower side than the small diameter portion may be a large diameter portion, and a lower stepped surface may be provided between the small diameter portion and the large diameter portion.

The upper side than the small diameter portion of the shaft case may be an enlarged diameter portion, and an upper stepped surface may be provided between the small diameter portion and the large diameter portion.

The head may include a head main body and the hosel bonded to the head main body.

A female screw may be carved on the inner circumferential surface of the hosel on the upper end side.

A male screw may be provided on the outer circumferential surface of the lower part of the screw member.

The screw member may be screwed into the hosel by screwing the male screw into the female screw of the hosel.

The shaft case may be fixed by pressing downward the lower stepped surface by the lower end surface of the screw member.

The shaft case may be capable of being pulled out from the hosel by pressing upward the upper stepped surface by the upper end surface of the screw member.

A weight material may be detachably mounted on the lower end of the shaft case.

The lower end side of the shaft case may be a non-circular cross-sectional shape portion.

A non-circular cross-sectional shape portion with which the leading end side of the shaft case is engaged may be provided in the hosel on the lower end side.

According to still another aspect of the invention, there is provided a method of adjusting the weight of the above golf club, including: replacing the screw member with another screw member having a different weight.

According to still another aspect of the invention, there is provided a method of adjusting the weight of the above golf club, including: replacing the weight material with another weight material having a different weight.

According to the above golf club and the above method of replacing the shaft of the present invention, it is possible to pull out the shaft case from the hosel by loosening and unscrewing the screw member. The shaft can be replaced by inserting a new shaft case and shaft connected body, which is obtained by attaching a shaft case to a shaft in advance, into the hosel and screwing the screw member. According to the present invention, the shaft case is strongly attached to the hosel since the shaft case is inserted into the tube-shaped hosel and the shaft case is fixed by the screw member. Since this screw member is constituted by split screw members, it is possible to easily replace the split screw members with other split screw members with different weights and thereby to adjust the balance and the weight of the head.

According to the above golf club, the lower end of the screw member presses the lower stepped surface of the shaft case when the screw member is screwed into the hosel on the upper end side, and the shaft case is fixed. The screw member presses upward the upper stepped surface when the screw member is rotated in the opposite direction, and the shaft case is pulled out from the hosel.

It is possible to adjust the balance and the weight of the head by replacing the weight material with the one having a different weight or by detaching the weight material if the weight material is detachably provided in the shaft case. It is possible to finely adjust the balance and the weight of the head by replacing the weight material if the weight material is formed to be lighter than the screw member.

According to the above golf club, the shaft case positioning is performed in the circumferential direction. In addition, the rotation between the head and the shaft case is prevented.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Figure 1:
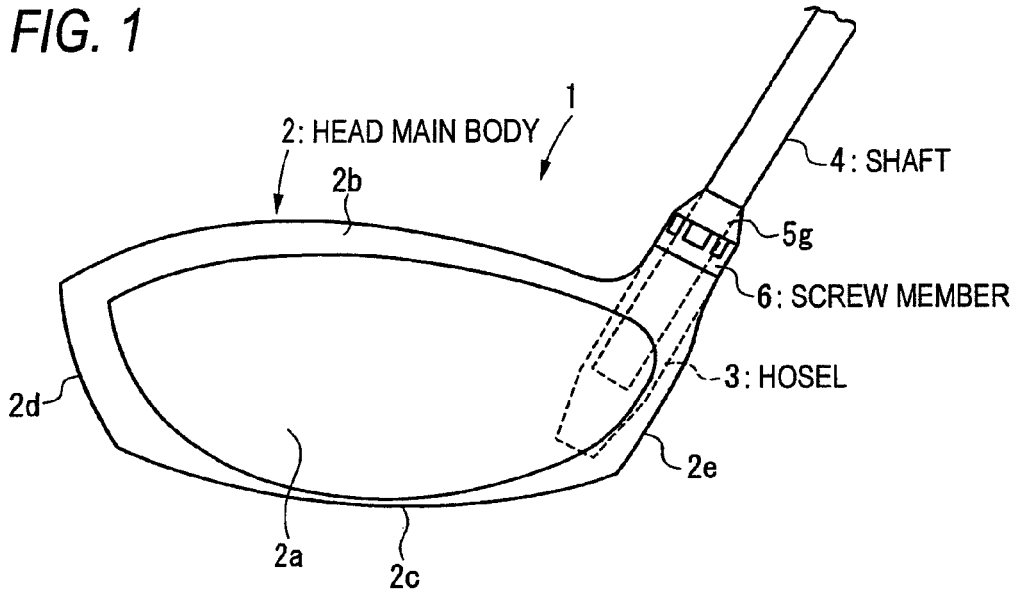
FIG. 1 is a front view of a head according to an embodiment.
Figure 2:
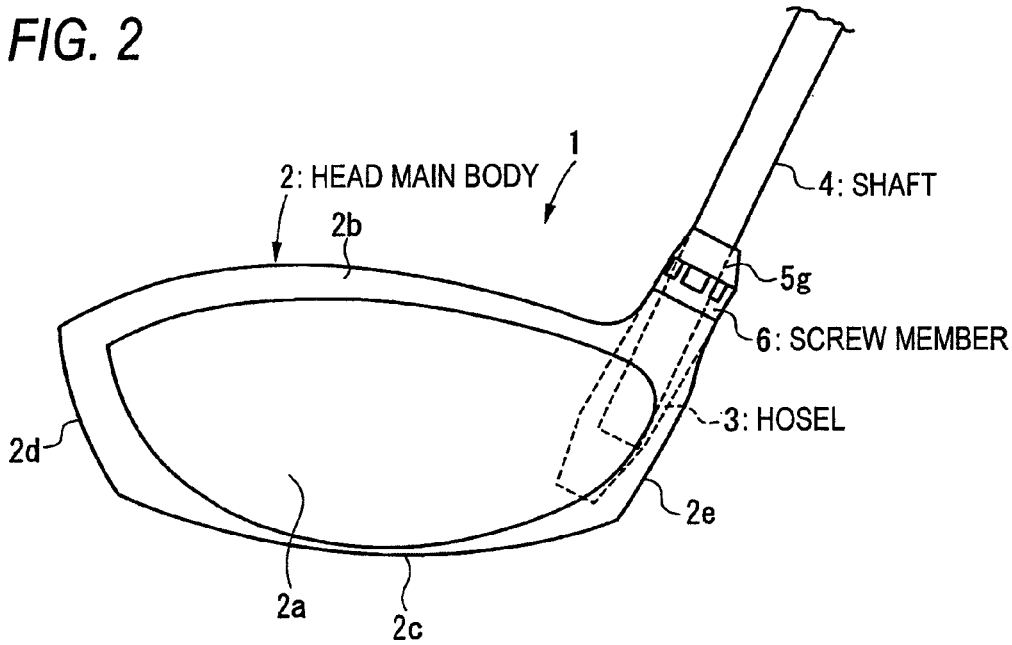
FIG. 2 is a front view of the head when the direction of a shaft is changed.
Figure 3:
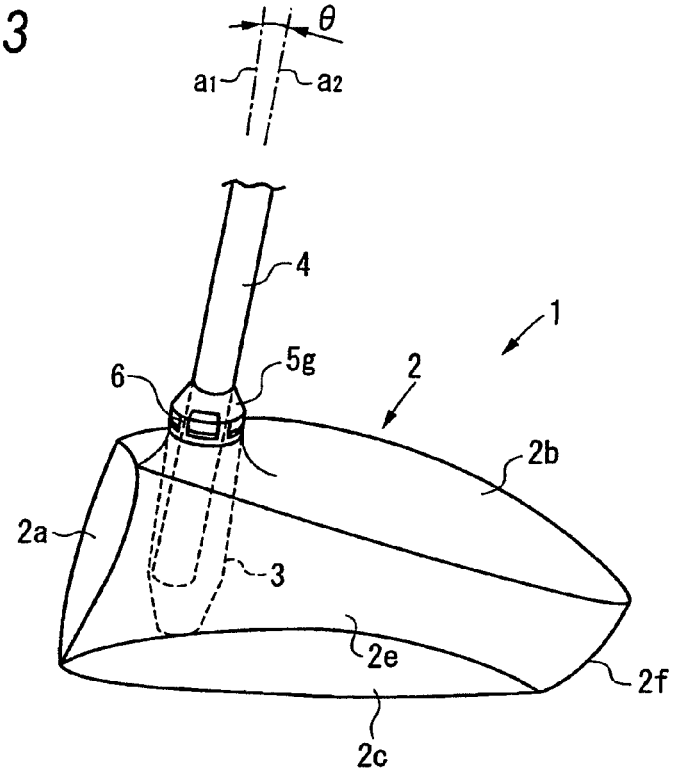
FIG. 3 is a side view of the head when the direction of the shaft is changed.
Figure 4:
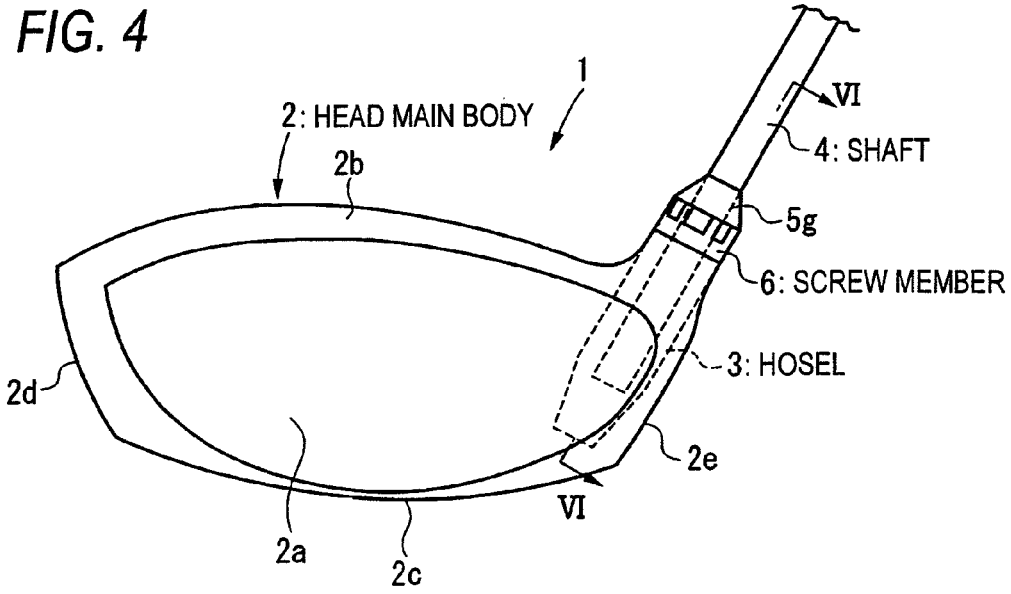
FIG. 4 is a front view of the head when the direction of the shaft is changed.
Figure 5:
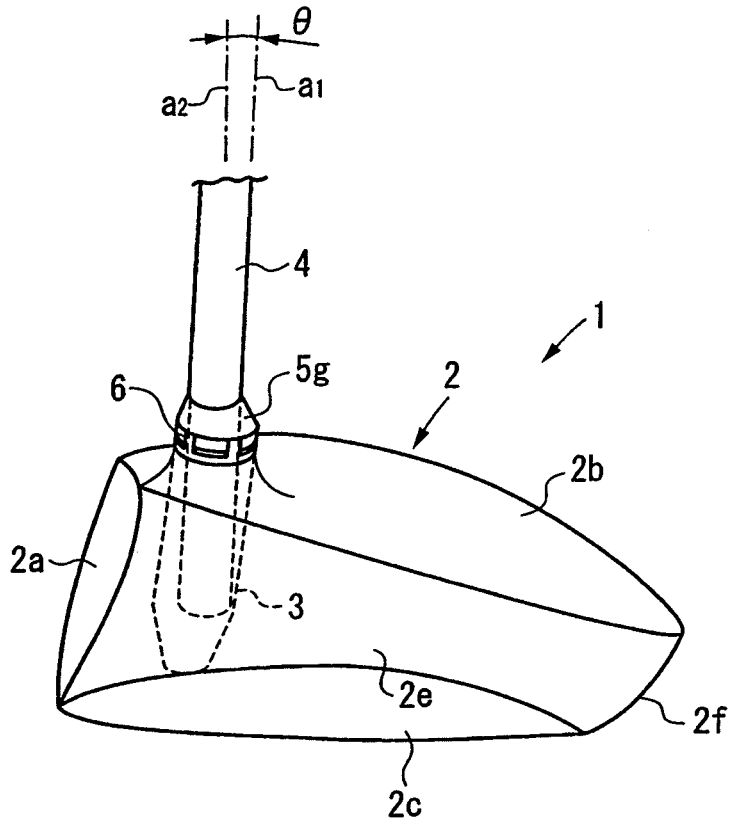
FIG. 5 is a side view of the head when the direction of a shaft case is changed.
Figure 6:
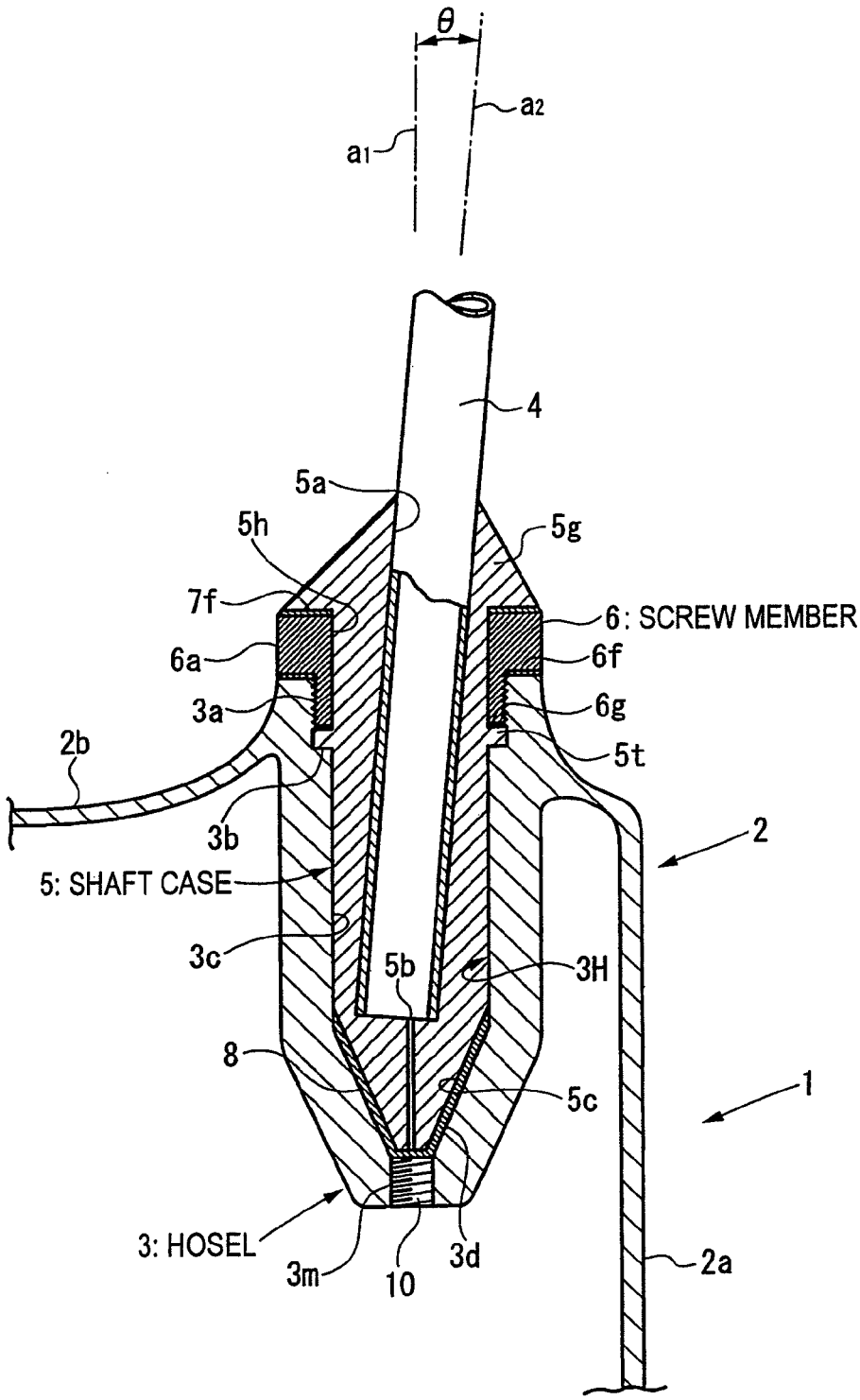
FIG. 6 is a cross-sectional view taken along VI-VI line in FIG. 4.

Hereinafter, description will be made of embodiments with reference to the drawings. FIG. 1 is a front view of a golf club head according to an embodiment, FIG. 2 is a front view of the golf club in which the shaft case is rotated by 180° from the state shown in FIG. 1 and attached again, FIGS. 3 and 4 are front views of the golf club in which the shaft case is rotated by 90° in the proper and the reverse directions from the state shown in FIG. 2, respectively and attached again. FIG. 5 is a side view of the golf club head in FIG. 4 on the heel side. FIG. 6 is a cross-sectional view taken along the VI-VI line in FIG. 4, and FIG. 7 is a perspective view of a hosel, a shaft case, a screw member, and a shaft leading end portion.

This golf club is obtained by attaching a shaft 4 to a hosel 3 of a head 1 via a shaft case 5 and a screw member 6.

This head 1 includes a head main body 2 and the hosel 3 integrally provided in the head main body 2. This head 1 is a hollow wood type and includes a face portion 2*a*, crown portion 2*b*, a sole portion 2*c*, a toe portion 2*d*, a heel portion 2*e*, and back portion 2*f*.

Figure 7:
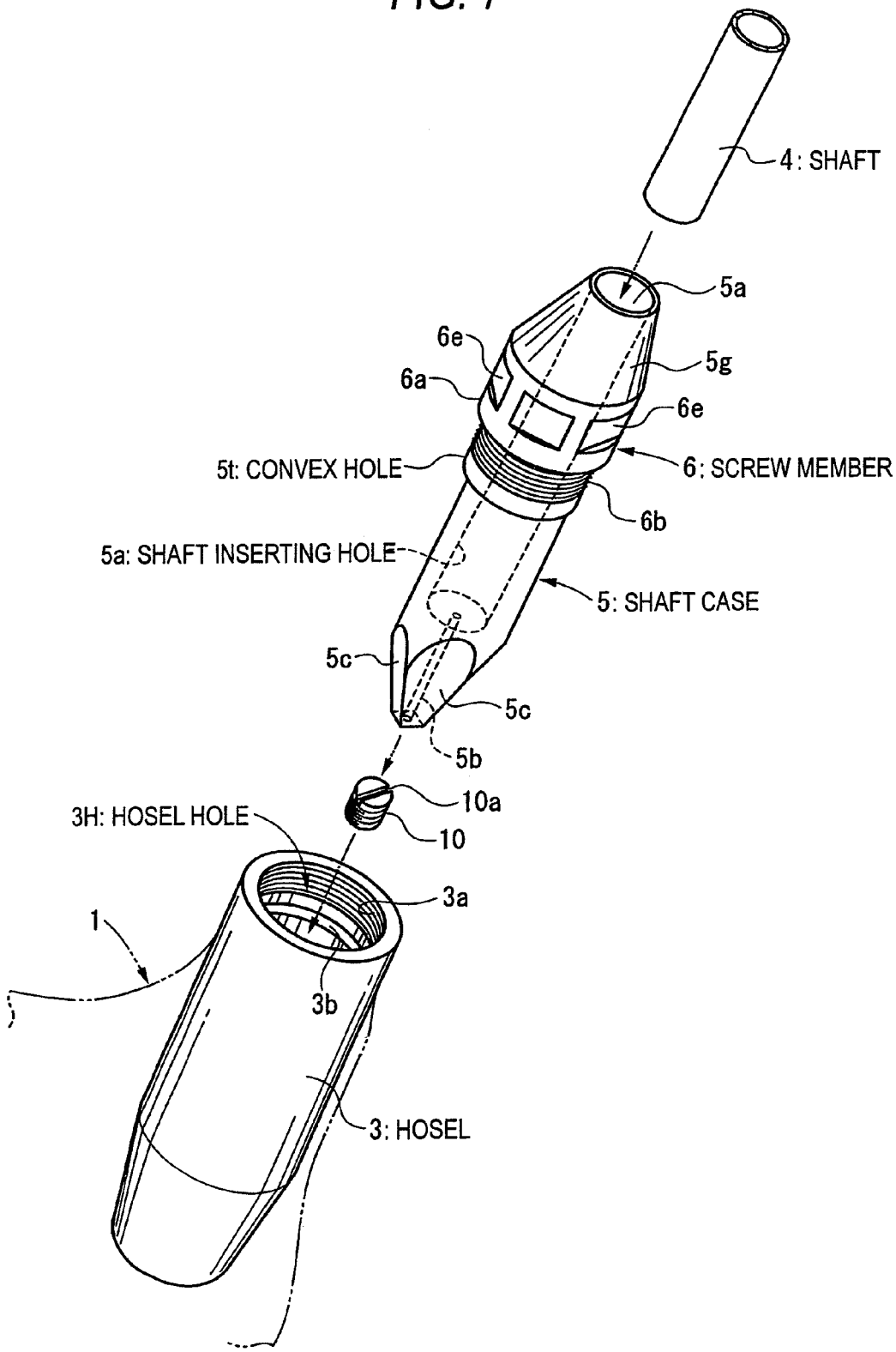
FIG. 7 is a perspective view of a hosel, a shaft case, and a screw member.

As shown in FIGS. 6 and 7, the hosel 3 has a substantially cylindrical shape in which a hosel hole 3H is pierced in the axial center line direction from the upper end to the lower end. Although the inner circumferential surface of this hosel hole 3H has the upper portion with a cylindrical shape and the lower portion with a regular square pyramid shape (more exactly, a truncated regular square pyramid shape) having a smaller diameter as it approaches the lower end, the inner circumferential surface may have a regular multiangular pyramid shape such as a regular triangular pyramid, a regular hexagonal pyramid, a regular octagonal pyramid, or the like as will be described later.

Figure 10A:
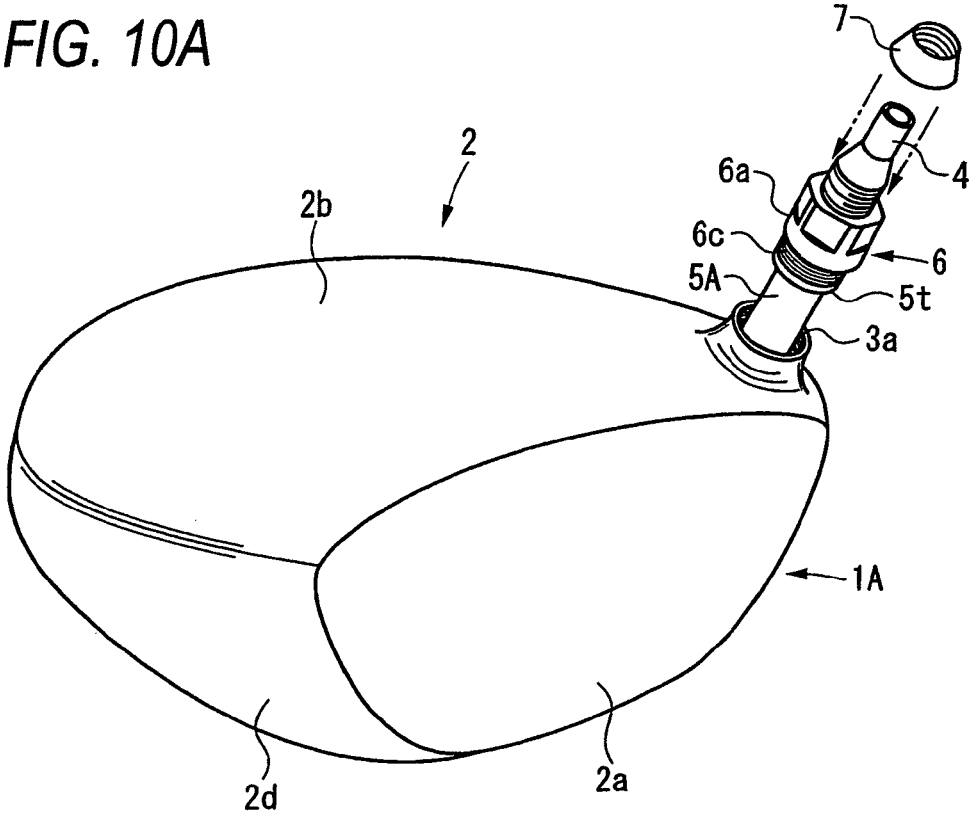
FIGS. 10A and 10B are exploded perspective views of the embodiment shown in FIG. 8.
Figure 10B:
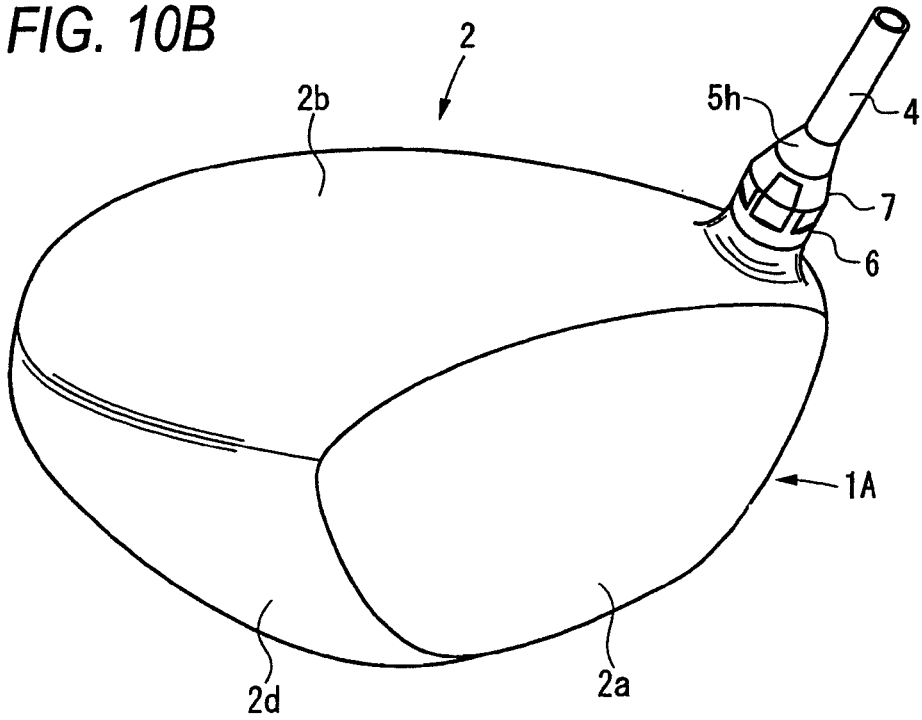

A communication opening 3*m* is provided so as to penetrate from the lower end portion of the hosel hole 3H to the inside of the head 1. In this embodiment, a female screw is carved on the outer circumferential surface of the communication opening 3*m*, and a weight material 10 having a male screw on its outer circumferential surface is screwed into the communication opening 3*m*. As shown in FIGS. 10A and 10B, a groove or a concave hole 10*a* is provided on the upper surface of this weight material 10 so as to engage with the leading end of a tool (for example, a driver or a hexagonal wrench). The groove or the concave hole 10*a* may have a minus shape or a cross shape, or may be a hexagonal hole.

A female screw 3*a* is provided in the inner circumferential surface on the entrance side of the hosel hole 3H, that is, the upper end side of the hosel. According to this embodiment, the screw member 6, which will be described later, is screwed into this female screw 3*a*.

A stepped surface 3*b* is provided in the diameter-reduced direction subsequently to the female screw 3*a*, and further to the inside this stepped surface 3*b* forms a cylindrical portion 3*c*. The surface further to the inside than this cylindrical portion 3*c* forms a regular square pyramid with a smaller diameter as it approaches the further side, and is provided with slopes 3*d* including four surfaces obliquely intersecting the axial center of the hosel 3. The intersecting angle (included angle) between a pair of slopes 3*d* and 3*d* which face each other preferably ranges from 10 to 30° and particularly from about 15 to 20°.

The shaft case 5 is a cylindrical member with a very slightly smaller diameter as compared with the cylindrical portion 3*c* of the hosel 3 and is provided with a shaft inserting hole 5*a* for inserting the shaft 4 from the upper end side to the lower end side. The outer circumferential surface of the shaft case 5 has a cylindrical shape except its lower portion. The inner circumferential surface of the shaft inserting hole 5*a* also has a cylindrical shape.

According to this embodiment, an axial center line $a_2$ of the shaft inserting hole 5*a* obliquely intersects with an axial center line $a_1$ of the outer circumferential surface of the shaft case 5. The intersecting angle θ (FIG. 6) between the axial center lines $a_1$ and $a_2$ preferably ranges from 0.1 to 5.0° and particularly from about 0.25 to 3.0°.

In addition, a configuration is also applicable in which the axial center lines $a_1$ and $a_2$ do not intersect with each other and are in a "skew" relation. That is, a configuration is applicable in which the axial center lines $a_1$ and $a_2$ do not cross with each other and are in the relation in which the axial center line $a_2$ passes in the vicinity of the axial center line $a_1$. The angle between the axial center lines $a_1$ and $a_2$ in this case may be set such that a plane including the axial center line $a_1$ and extending in the flying ball line direction is assumed while assuming that the axial center line $a_2$ is in the inclination state to the maximum extent to the heel side and the intersecting angle between the assumed plane and the axial center line $a_2$ is in the range of the above angle θ.

The outer diameter of the shaft case 5 preferably ranges from 12 to 20 mm and particularly from about 13 to 15 mm, and the inner diameter of the shaft inserting hole 5*a* preferably ranges from 8 to 10 mm and particularly from 8.5 to 9.0 mm. The outer diameter of the hosel 3 preferably ranges from 13 to 20 mm and particularly from about 15 to 19 mm.

A small opening 5*b* for removing air is pierced in the lower end surface of the shaft case 5 from the furthest bottom surface of the shaft inserting hole 5*a*.

A convex portion 5*t* is provided on the outer circumferential surface of the shaft case 5 in the middle of the direction of the axial center line (longitudinal direction). In this embodiment, the convex portion 5*t* has a flange shape which surrounds the shaft case 5. This convex portion 5*t* has a diameter which comes in contact with the stepped surface 3*b* from its upper side.

The outer surface of the shaft case 5 on the lower end side has a square pyramid shape (more exactly, a truncated square pyramid shape) with a smaller diameter as it approaches the lower end and is provided with slopes 5*c* including four surfaces. The slopes 5*c* are symmetrically provided while interposing the axial center line of the shaft case 5. The intersecting angle between a pair of facing slopes 5*c* and 5*c* is the same as the intersecting angle between the slopes 3*d* and 3*d* of the hosel 3. The size of the slope 5*c* of the shaft case 5 may be the same as that of the slope 3*d* of the hosel 3, and may be slightly smaller when an elastic body is interposed.

An enlarged diameter portion 5*g* having an outer circumferential surface with a tapered shape in which the diameter becomes smaller as it approaches the upper side is integrally provided on the upper end of the shaft case 5. This enlarged diameter portion 5*g* has a circular cone shape with a deviated center, and includes a shaft inserting opening 5*a* on its upper surface. The lower surface of the enlarged diameter portion 5*g* is superimposed on the upper surface of the screw member 6 via the space 7*f* (FIG. 6).

A part following the lower side of the enlarged diameter portion 5*g* in the shaft case 5 forms a small diameter portion 5*h* (FIG. 6). The screw member 6 is rotatably fitted onto this small diameter portion 5*h*. The convex portion 5*t* is provided at a position lower than the small diameter portion 5*h* of the shaft case 5. The lower end surface of the screw member 6 is in contact with this convex portion 5*t* via the spacer 6*g*.

Although not shown in the drawings, a configuration is also applicable in which a chamfer with an angle of about 20 to 45° is formed in the inner circumferential edge of the shaft inserting hole 5*a* on the upper end side in order to make it easier to insert the shaft 4.

The screw member 6 has a substantially ring shape in which the lower half portion has a smaller diameter as compared with the upper half portion 6*a*, and a male screw 6*b* (FIG. 7) is carved on the outer circumferential surface of the lower half portion. As shown in FIG. 7, six flat plane portions 6*e* are provided on the outer circumferential surface of the upper half portion 6*a* on the upper end side and form a nut shape. The screw member 6 can be rotated by holding these flat plane portions 6*e* with a tool such as an adjustable wrench, a spanner, or the like.

When a golf club is assembled, the weight material is screwed into the communication opening 3*m*. In addition, it is also applicable that the agglutinant is supplied in the head 1 through the communication opening 3*m* before the weight material 10 is screwed. In addition, the leading end of the shaft 4 is inserted into the shaft inserting hole 5*a* of the shaft case 5 and bonded with the use of the adhesive as shown in FIG. 7. Preferably, the outer circumferential surface of the leading end portion of the shaft 4 is coated with this adhesive, and the shaft 4 is inserted up to the furthest portion of the shaft inserting hole 5*a*. As the adhesive, an epoxy adhesive or the like is preferably used.

Since a small opening 5*b* is provided in the shaft case 5, the air flows out through the small opening 5*b* when the shaft 4 is inserted into the shaft inserting hole 5*a*.

As described above, the shaft case 5 in the shaft case and shaft connected body, to which the screw member 6 is attached and the shaft case 5 is bonded, is inserted into the hosel hole 3H. In addition, a thin piece shaped elastic body 8 made of thin (for example, about 0.5 to 5 mm in the thickness) rubber, elastomer, or the like is provided on the slope 5*c* of the shaft case 5 and the leading end surface of the shaft case 5 by coating, pasting, or the like in this embodiment. The elastic body 8 may be provided in the shaft case 5 in advance, or may be provided in the shaft case 5 after the shaft case and shaft connected body are configured.

The shaft case 5 of the shaft case and shaft connected body is inserted into the hosel hole 3H so as to interpose the slopes 5*c* and 3*d*, and the male screw 6*b* of the screw member 6 is then screwed into the female screw 3*a* in the inner circumferential surface of the upper portion of the hosel hole 3H.

With such a configuration, the lower end surface of the screw member 6 presses the convex portion 5*t* of the shaft case 5, the slopes 5*c* of the shaft case 5 are pressed against the slopes 3*d* of the hosel 3 via the elastic body 8, and the shaft case 5 is fixed to the hosel 3 as shown in FIGS. 3 to 6. Since the shaft case 5 and the shaft 4 are fixedly adhered with the adhesive, a golf club in which the shaft 4 and the head 1 are integrally formed is thus completed.

In FIGS. 4 to 6, the shaft 4 is in the state of inclining toward the flying ball line direction, that is, toward the face portion 2*a* side to the maximum extent. In FIG. 1, which will be described later, the inclination direction can be changed as in FIG. 2.

When the shaft case 5 is pulled out from this golf club, the screw member 6 is rotated in the loosening direction. Since the male screw 6*b* of this screw member 6 is screwed into the female screw 3*a* of the hosel 3, the screw member 6 moves upward (advances by screwing) and presses the enlarged diameter portion 5*g* up if the screw member 6 is rotated in the loosening direction, and the shaft case 5 moves upward. With such a configuration, the shaft case 5 can be easily detached since it moves to the upper direction in which the shaft case 5 is separated from the hosel 3.

It is possible to adjust the balance of the golf club by replacing the weight material 10 with another weight material having different weight when necessary after the shaft case 5 is detached as described above. As the weight material with different weight, a weight material made of a material with a different specific gravity may be used. Examples of the material for the weight material include nylon, aluminum, stainless, tungsten, and the like. In addition, the weight material 10 may be detached.

A configuration is also applicable in which the shaft case 5 is pulled out from the hosel 3, the direction is then changed by rotating by 90° or 180°, the shaft case 5 is inserted into the hosel hole 3H again, and the screw member 6 is inserted into the female screw 3*a*. In this embodiment, the axial center line $a_2$ of the shaft inserting hole 5*a* inclines with respect to the axial center line $a_1$ of the hosel hole 3H by the angle θ. Accordingly, it is possible to change the inclination direction of the shaft 4 by rotating the shaft case 5 by 90° or 180°. In FIG. 1, the shaft 4 inclines toward the heel side to the maximum extent. In FIG. 2, the shaft 4 inclines toward the toe side to the maximum extent. In FIG. 3, the shaft 4 is in the state in which it inclines backward to the maximum extent.

It is possible to change the lie angle and the slice angle by changing the inclination direction of the shaft 4 as described above.

If the explanation is made for the lie angle, it is the smallest in FIG. 1 and a flat lie, and it is the largest in FIG. 2 and an up lie. FIGS. 3 to 6 respectively show the lie angle in the intermediate level between both shown in FIGS. 1 and 2. If the explanation is made for the slice angle, FIGS. 4 to 6 respectively show the hook face in which the face plane is closed to the maximum extent, FIG. 3 shows the slice face in which the face plane is opened to the maximum extend, and FIGS. 1 and 2 respectively show the slice angle in the intermediate level between both shown in FIGS. 4 to 6 and FIG. 3.

As described above, it is possible to adjust the balance by replacing the weight material, change the inclination direction of the shaft 4 with respect to the head 1, and change the lie angle and the slice angle according to this embodiment.

Although the enlarged diameter portion 5*g* has a tapered shape in this golf club, it is also applicable that an enlarged diameter portion with a flat flange shape is provided and a ferrule is attached on the upper side thereof.

In this embodiment, the screw member 6 is fitted onto the shaft case 5 and screwed into the hosel 3, and the screw member 6 does not contact with the shaft 4 when rotated. Accordingly, it is possible to prevent the shaft 4 from being damaged.

In addition, a thin piece shaped elastic body 8 made of rubber, elastomer, synthetic resin, or the like is interposed between the slope 3*d* of the hosel 3 and the slope 5*c* of the shaft case 5, and therefore, shock and vibration caused at the time of the impact can be absorbed.

Since the inner surface of the further side in the hosel hole 3H and the outer surface of the shaft case 5 on the lower end side are respectively made to have a square pyramid shape by providing the slopes 3*d* and 5*c*, and these slopes 3*d* and 5*c* are engaged with each other, less slipping occurs, and the rotation of the shaft 4 about a direction around the axial center of the shaft is prevented. That is, high fixing rigidity of the shaft 4 in the torque direction can be achieved.

In addition, the shaft case 5 can be easily inserted into the hosel 3 since the leading end side of the shaft case 5 is made to have a tapered shape by providing the slopes 5*c* including four surfaces.

When the shaft of the golf club is to be replaced, the same shaft case as the above-mentioned shaft case 5 is bonded to a new shaft, with which the existing shaft is to be replaced, in advance with the adhesive. In addition, the screw member 6 is also attached to this shaft.

The screw member 6 of the existing golf club is rotated, and the old shaft 4, the old shaft case 5, and the screw member 6 are detached from the head 1 together. Subsequently, a new shaft with a shaft case and a screw member (shaft case and shaft connected body) is inserted into the hosel hole 3H of the head 1, and the screw member 6 is screwed into the female screw 3*a* to fix the new shaft.

As described above, it is possible to perform attachment and replacement of the shaft very easily and rapidly. Conventionally, it took several hours to about a day to replace the shaft since the hosel portion of the existing golf club was heated to destroy the composition of the adhesive hardener, the shaft was pulled out, and a new shaft was then bonded with adhesive. However, it is possible to replace the shaft in several minutes by attaching the shaft case 5 to the new shaft with adhesive in advance in the embodiment. Accordingly, it is possible to implement a usage style in which different shafts are sequentially attached to the same head main body for trial shots by preparing the shafts of various specifications, to each of which the shaft case is attached.

In addition, it is also applicable that the shaft case 5 having the shaft inserting hole 5*a* with a different inclination angle θ is manufactured and the shaft is bonded to this shaft case to obtain the shaft case and shaft connected body for the replacement. The lie angle and the slice angle can be changed by replacing the existing shaft case and shaft connected body with this shaft case and shaft connected body as the replacement.

For example, it is possible to perform trial shots while changing the lie angle and the slice angle little by little by preparing a shaft case group including plural kinds of shaft cases for the replacement, in which the above angle θ is changed little by little as 0.5°, 1°, 1.5°, 2°, 2.5°, 3°.

In this embodiment, the upper end of the shaft inserting hole 5*a* deviates from the center of the upper end of the shaft case 5 as can be clearly understood from FIGS. 6 and 7. Accordingly, it is possible to know the direction of the shaft case 5 based on the position of the upper end of this shaft inserting hole 5*a*, and to thereby easily know to which direction the shaft 4 inclines based on this direction of the shaft case 5. In addition, it is possible to allow the inclination of the axial center to be larger as compared with the one shown in FIG. 8, which will be described later, and to thereby greatly change the lie angle and the slice angle.

However, the upper end of the shaft inserting hole 5*a* may be formed at the center of the upper end of the shaft case 5. In such a case, the tapered surface of the enlarged diameter portion 5*g* becomes a regular circular cone shape, and a good appearance can be achieved.

Figure 8:
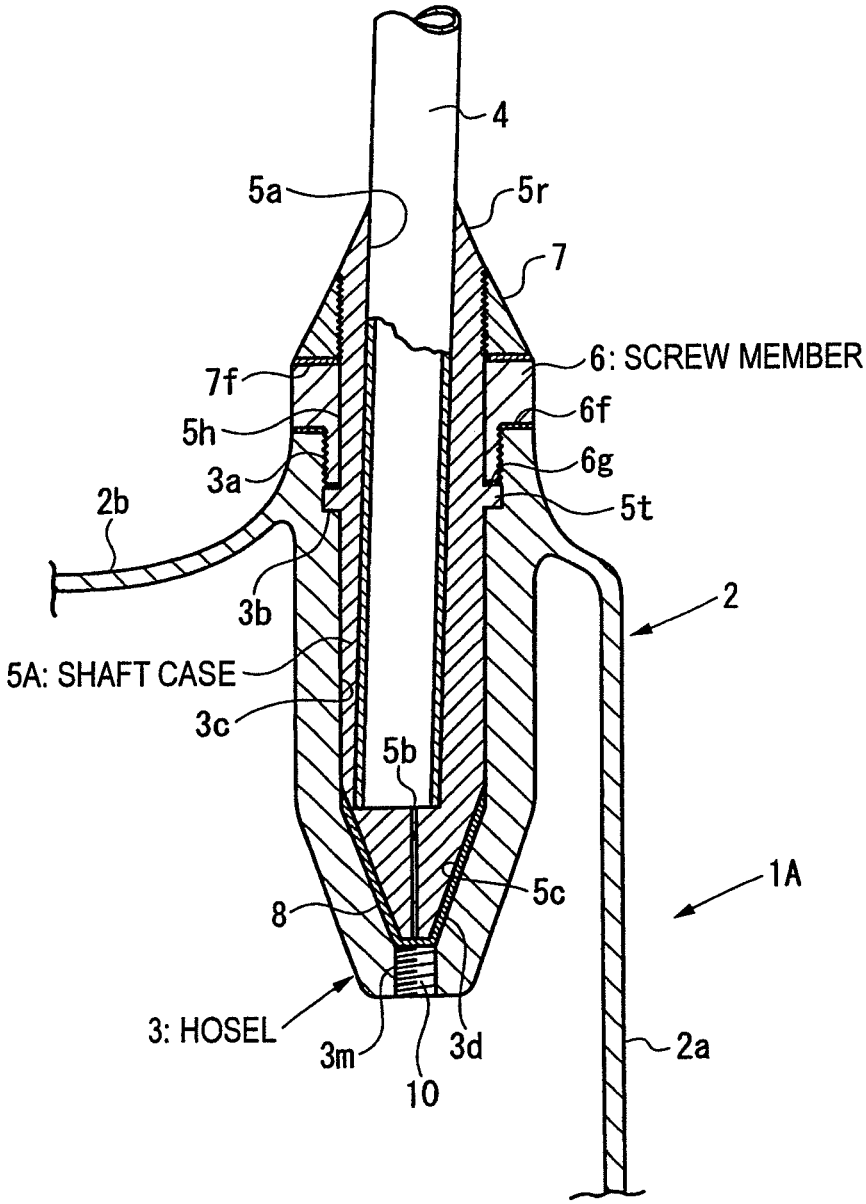
FIG. 8 is a cross-sectional view showing another embodiment.
Figure 9:
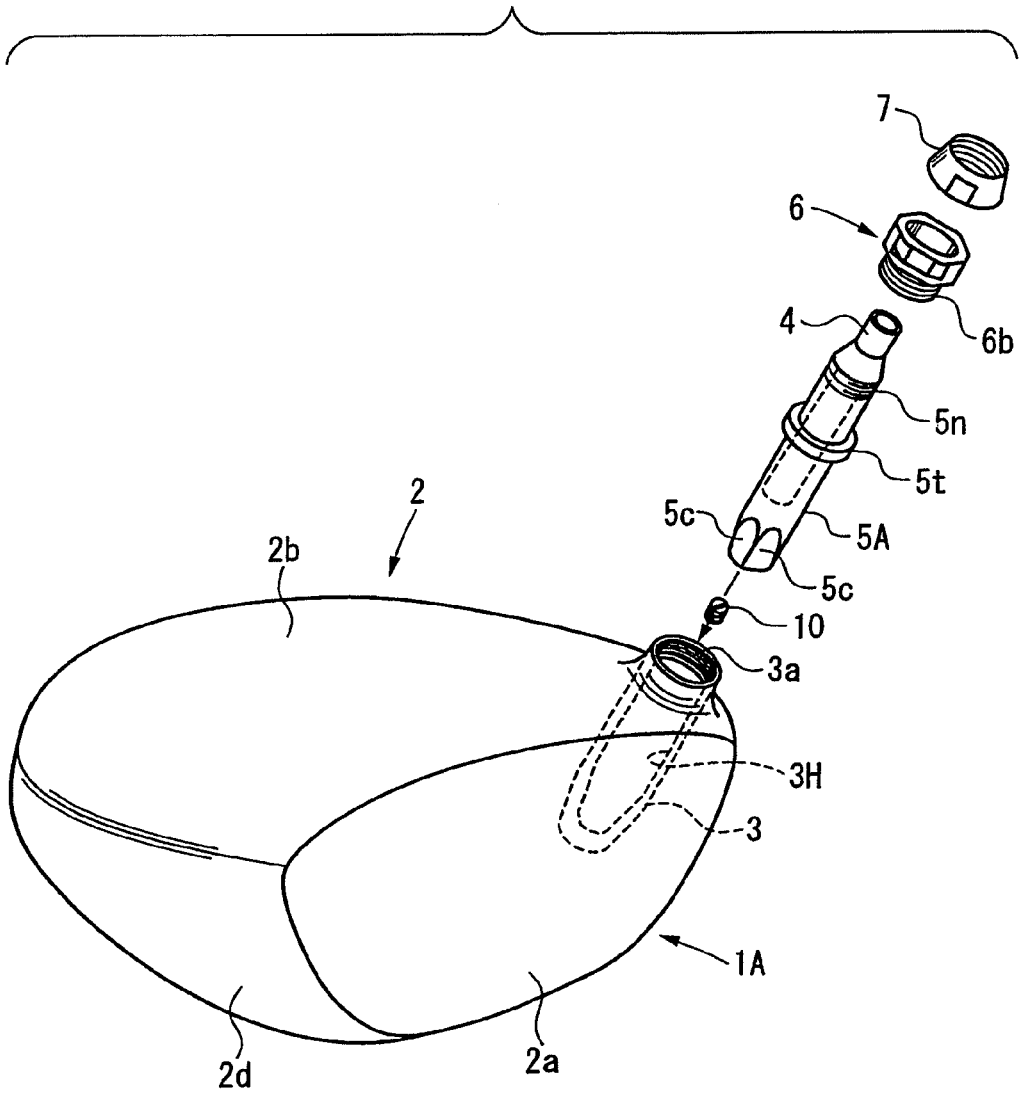
FIG. 9 is an exploded perspective view of the embodiment shown in FIG. 8.

Another embodiment will be described with reference to FIGS. 8 to 12. FIG. 8 is a cross-sectional view of the same part as that shown in FIG. 3, of a golf club head according to another embodiment, FIGS. 9, 10A, and 10B are perspective views showing methods of attaching and replacing the shaft, FIG. 11 is a perspective view of the hosel, the shaft case, the screw member, and the top portion, and FIG. 12 is a cross-sectional view of the hose, the shaft case, the screw member, and the top portion.

This golf club is obtained by attaching a separate top portion 7 to the upper end portion of the shaft case 5A which has been bonded to the hosel 3 of the head 1A.

Figure 11:
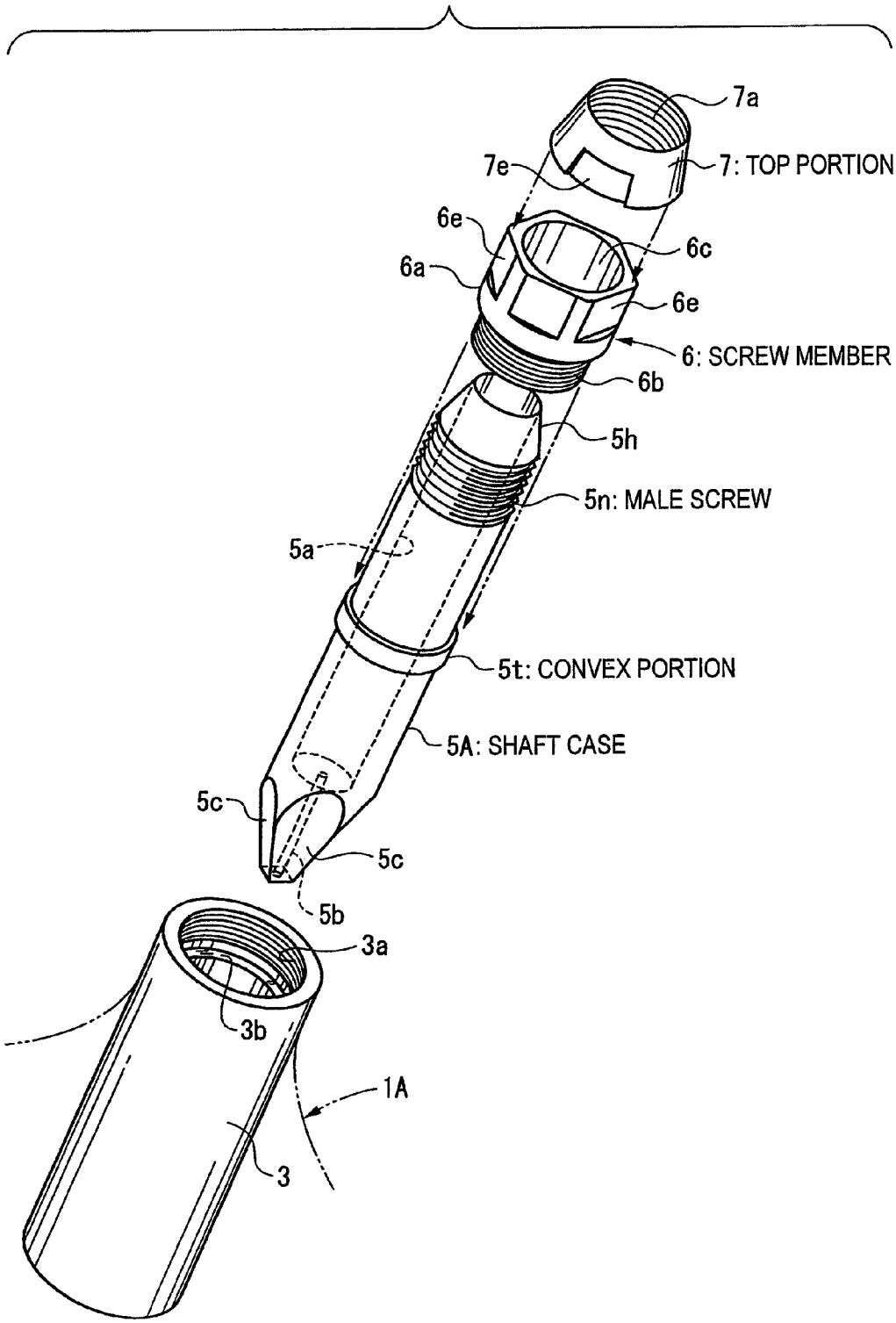
FIG. 11 is an exploded perspective view of the embodiment shown in FIG. 8.
Figure 12:
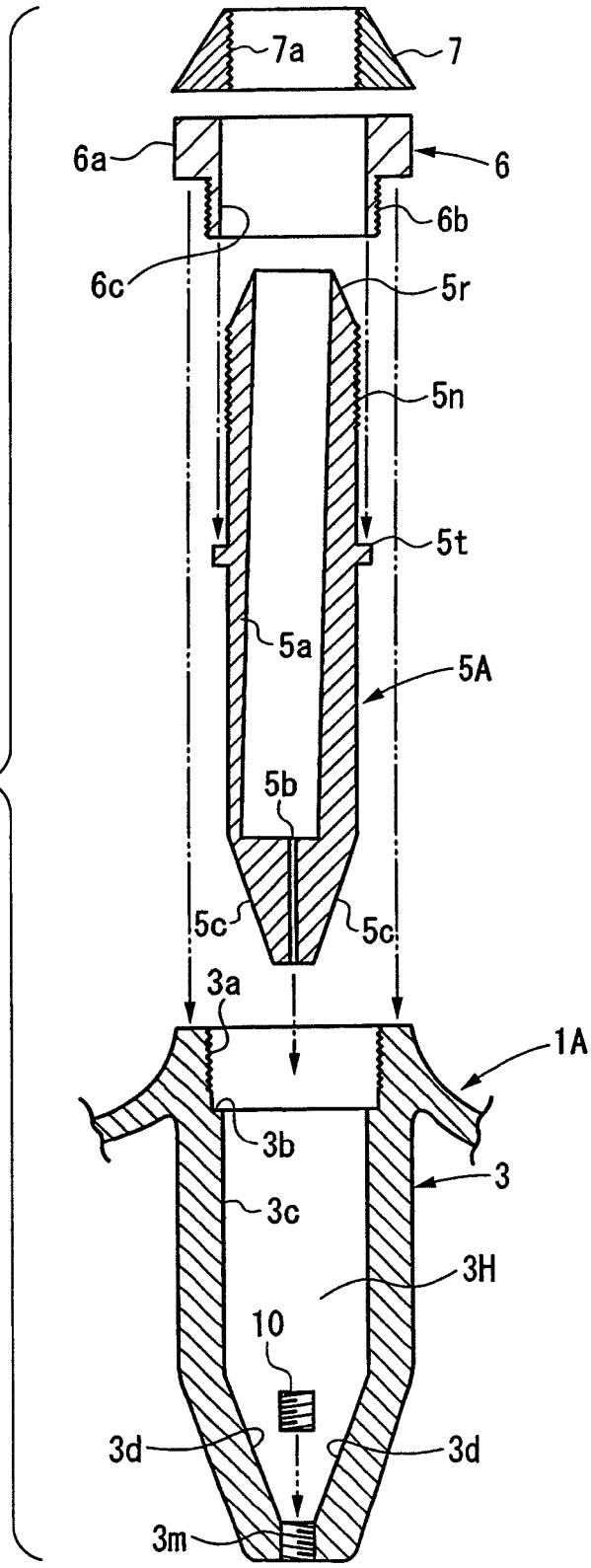
FIG. 12 is an exploded cross-sectional view of the embodiment shown in FIG. 8.

As shown in FIGS. 11 and 12, the shaft case 5A is a cylindrical member with a very slightly smaller diameter as compared with the cylindrical portion 3*c* of the hosel 3 in the same manner as the shaft case 5 in the above mentioned embodiment, and a hole 5*a* for inserting the shaft 4 is provided from the upper end side to the lower end side.

The upper end of the shaft case 5A is formed with a tapered portion 5*h* with a diameter which becomes smaller as it approaches the upper side. A male screw 5*n* is provided on the outer circumferential surface of the upper portion of the shaft case 5A following this tapered portion 5*h*. A top portion 7 is screwed onto this male screw 5*n*.

The configurations of the hosel 3 and the screw member 6 are the same as those in the above embodiment, and the weight material 10 is screwed into the communication opening 3*a* at the lower end portion of the hosel hole in the same manner.

According to this embodiment, the top portion 7 is provided further to the upper side than the screw member 6. This top portion 7 has a tapered ring shape in which the diameter of the outer circumferential surface becomes smaller as it approaches the upper side. A female screw 7*a* (FIG. 12) into which the male screw 5*n* of the shaft case 5 is screwed is provided on the inner circumferential surface of the top portion 7. As shown in FIG. 11, a pair of parallel planes 7*e* is provided on the outer circumferential surface of the top portion 7 on the lower end side. With such a configuration, it is possible to rotate the top portion 7 while a tool is made to be engaged with this parallel plane 7*e*. A thin spacer 7*f* made of an elastic body such as rubber, elastomer, or the like, plastic, or metal is interposed between the top portion 7 and the screw member 6 in the same manner as in the above embodiment. In addition, the top portion 7 may be fixed to the shaft case 5 by welding, adhesion, swaging, or the like.

The other configurations in this embodiment are the same as those in the above embodiment, and the same reference numerals represent the same parts.

When the golf club of this embodiment is to be assembled, the weight material 10 is screwed into the communication opening 3*a*. In addition, the top portion 7 and the screw member 6 are fit from the leading end side of the shaft 4, and the shaft case 5A is bonded to the leading end of the shaft 4 with the use of the adhesive as shown in FIG. 9. Preferably, the outer circumferential surface of the leading end portion of the shaft 4 is coated with this adhesive, and the shaft 4 is inserted into the hole 5*a* of the shaft case 5A up to its furthest portion.

Since the small opening 5*b* is provided in the shaft case 5A, the air flows out through the small opening 5*b* when the shaft 4 is inserted into the hole 5*a* of the shaft case 5A. As the adhesive, an epoxy adhesive or the like may be preferably used.

The shaft case 5A in the shaft case and shaft connected body, to which the top portion 7 and the screw member 6 are fitted and inserted and the shaft case 5A is bonded as described above, is inserted to the hosel 3 of the head 1A as shown in FIGS. 9 and 10A.

Subsequently, the male screw 6*b* of the screw member 6 is screwed into the female screw 3*a* of the hosel 3, and the top portion 7 is then screwed onto the male screw 5*a* of the shaft case 5A as shown in FIG. 10B.

In this manner, the lower end surface of the screw member 6 presses the upper surface of the convex portion 5*t* of the shaft case 5A, the slopes 5*c* of the shaft case 5A are pressed against the slopes 3*d* of the hosel 3 via the elastic body 8, and the shaft case 5A is fixed to the hosel 3 as shown in FIG. 8. Since the shaft case 5 and the shaft 4 are fixedly adhered with the adhesive, a golf club in which the shaft 4 and the head 1A are integrally formed is thus completed.

When the shaft case 5A is pulled out from this golf club, the screw member 6 is rotated in the loosening direction while the top portion 7 is maintained in an attached state. Since the male screw 6*b* of this screw member 6 is screwed into the female screw 3*a* of the hosel 3, the screw member 6 moves upward (advances by screwing) and presses up the top portion 7 if the screw member 6 is rotated in the loosening direction. The top portion 7 is bonded to the shaft case 5A, and therefore, the top portion 7 and the shaft case 5A integrally move upward when the top portion 7 is pressed up by the screw member 6. With such a configuration, the shaft case 5A can be easily detached since it moves to the upper direction in which the shaft case 5A is separated from the hosel 3. It is possible to adjust the balance of the golf club by replacing the weight material 10 with the one having a different weight or detaching the weight material 10 in this state.

Since the axial center line of the shaft inserting hole 5*a* obliquely intersects with the axial center line of the outer circumferential surface of the shaft case 5A in this embodiment as well, it is possible to change the inclination direction of the shaft 4 to the heel side, the toe side, the flying ball line direction, or backward. With such a configuration, the same effects as those in the above embodiment can be achieved. In addition, the upper end of the shaft inserting hole 5*a* is positioned at the center, and a tapered surface with the same taper angle can be configured from the tapered surface of the top portion 7 to the tapered portion 5*h* of the shaft case 5A in this embodiment. Accordingly, there is less strange feeling outwardly as compared with the one shown in FIG. 6.

In addition, since the top portion 7 is screwed onto the male screw 5*n* of the shaft case 5A after the screw member 6 is screwed into the female screw 3*a* of the hosel 3, it is possible to prevent the screw member 6 from being loosened. Since the female screw 3*a* and the male screw 6*b* are reverse screws especially in this embodiment, and the loosening rotation direction of the screw member 6 is a fastening rotation direction of the top portion 7, it is possible to prevent the screw member 6 from being loosened.

It is preferable that the hosel, the shaft case, and the screw member are made of metal, particularly, aluminum, titanium, or an alloy thereof. The hosel 3 is preferably made of a material with a specific gravity equivalent to or lower than that of the head main body, and titanium alloy, aluminum, aluminum alloy, magnesium alloy, FRP, synthetic resin or the like may be used, for example.

Although the material of the head is not particularly limited, titanium alloy, aluminum alloy, stainless, or the like may be used, for example, in the case of a wood type golf club head.

Although the slopes 5*c* and 3*d*, each of which includes four surfaces, are provided in the shaft case and the hosel hole so as to form regular square pyramids in the above embodiment, regular multiangular pyramids including 3 or not less than 5 slopes are also applicable. In addition, the leading end side of the shaft case and the further side of the hosel hole may be formed to have concave multiangular sectional shapes such as star shapes or the like or gear sectional shapes.

In addition, a grip with a non-true-circular cross section may be used in some cases as the grip to be attached to the shaft 4. For example, the lower side surface in the outer circumferential surface of the grip, which is direct to the ground in the address state, is made to have a shape protruding as compared with the other surfaces. In such a case, the grip protruding portion does not direct the ground side in some cases when the direction of the shaft case 5 is changed. Thus, it is preferable to use a grip with a true-circular cross section in the present invention.

Although the golf club head is a wood type in the above embodiment, the present invention can also be applied to any type of golf club head including a utility type, an iron type, a putter, and the like.

In the case of a hollow type golf club head shown in the drawings, the weight on the heel side is heavier as compared with a general golf club head since the hosel 3, the hosel placement portion 2*g*, the shaft case 5 or 5A, and the screw member 6 are provided. Accordingly, it is preferable to configure the toe side or the back portion to be thicker or provide a weight on the toe side in order to keep a good balance for the golf club head.

As described above, it is applicable that the agglutinant is supplied into the hollow golf club through the communication opening 3*m* and an agglutinant layer is formed on at least a part of the inner surface of the golf club to cause the foreign matter to adhere and to be caught. Since the weight material 10 is attached to the communication opening 3*m* in the present invention, the agglutinant does not flow back to the inside of the hosel hole through the communication opening 3*m* even if the golf club is upset by mistake before this agglutinant is cured.

Although the lie angle and the slice angle can be adjusted in the above embodiments, it is also possible to apply the present invention to the golf club for which the lie angle and the slice angle are not adjusted as in JP-A-2009-254449 and 2010-57554.

Figure 13:
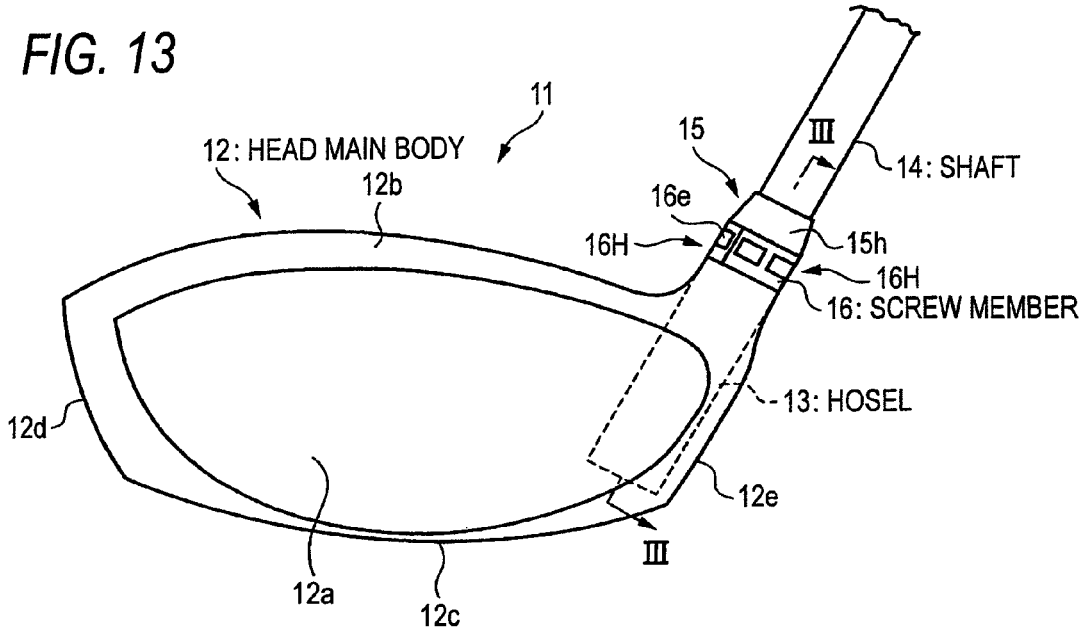
FIG. 13 is a front view of a head according to an embodiment.
Figure 14:
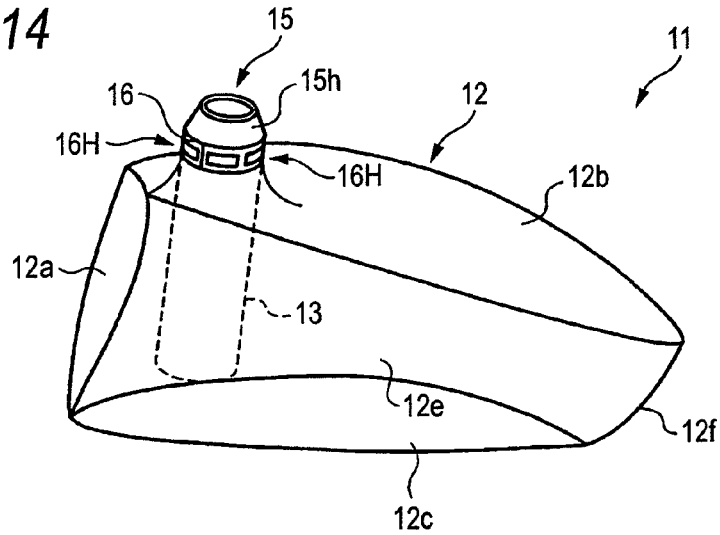
FIG. 14 is a side view of the head on the heel side.

Hereinafter, description will be made of still another embodiment with reference to the drawings. FIG. 13 is a front view of a golf club head according to an embodiment, FIG. 2 is a side view of the golf club head on the heel side. This golf club is obtained by attaching a shaft 14 to a hosel 13 of a head 11 via a shaft case 15 and a screw member 6.

This head 11 includes a head main body 12 and the hosel 13 attached to this head main body 12. This head 11 is a hollow wood type and includes a face portion 12*a*, crown portion 12*b*, a sole portion 12*c*, a toe portion 12*d*, a heel portion 12*e*, and back portion 12*f*.

Figure 15:
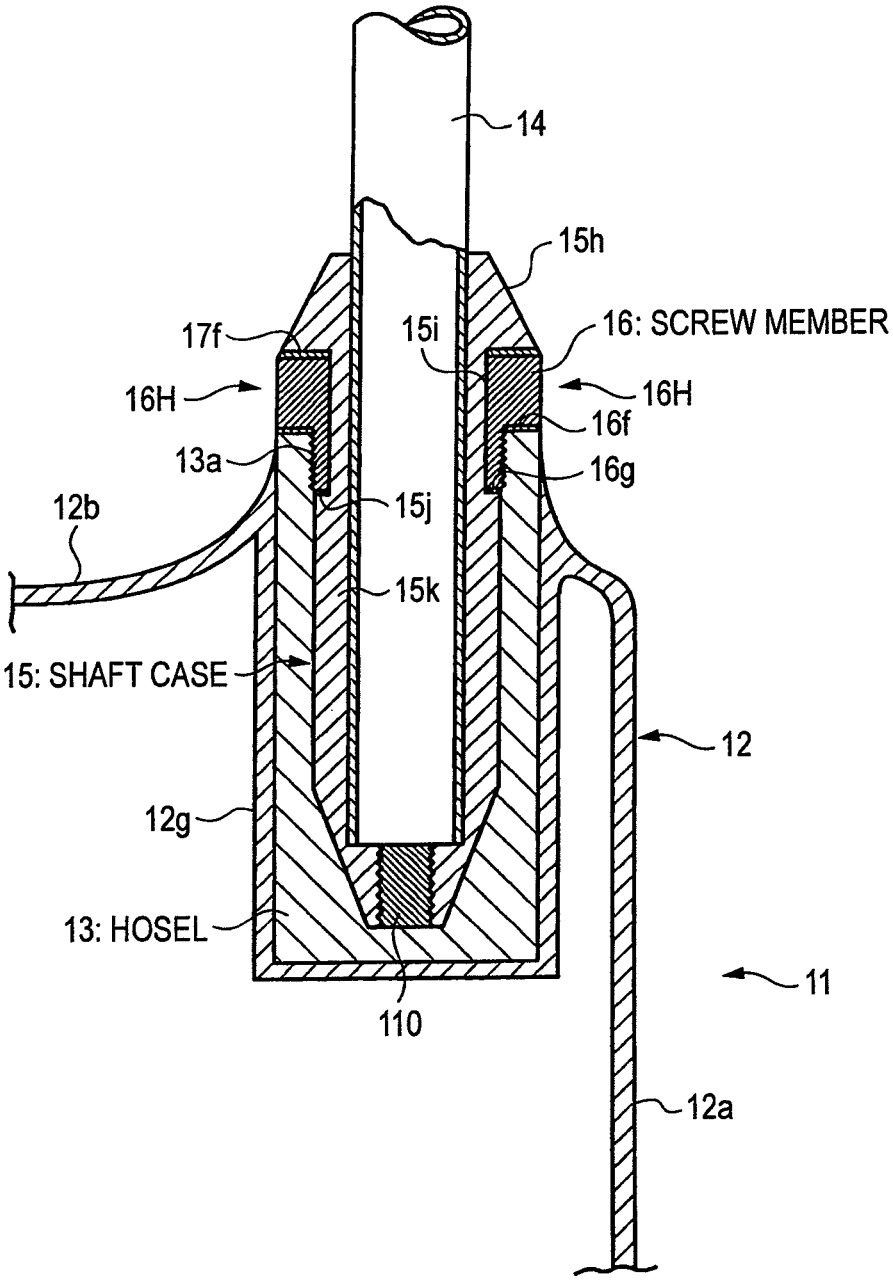
FIG. 15 is a cross-sectional view taken along the line in FIG. 13.

As shown in FIG. 15, a cylindrical hosel placement portion 12*g* is provided on the heel portion 12*e* side and the face portion 12*a* side of the crown portion 12*b*. This hosel placement portion 12*g* has a cylindrical shape with an opened upper end and a closed lower end and extends in a coaxial state with the shaft 14. The hosel 13 is inserted into this hosel placement portion 12*g* from the upper direction and bonded by appropriate bonding means such as welding, brazing, adhering, shrink-fitting, cool-fitting, or the like. In addition, the hosel may be integrally formed with the head main body. For example, the hosel may be integrally produced with the head main body by casting and processing with a CNC processor in order to enhance its dimensional accuracy.

Figure 16:
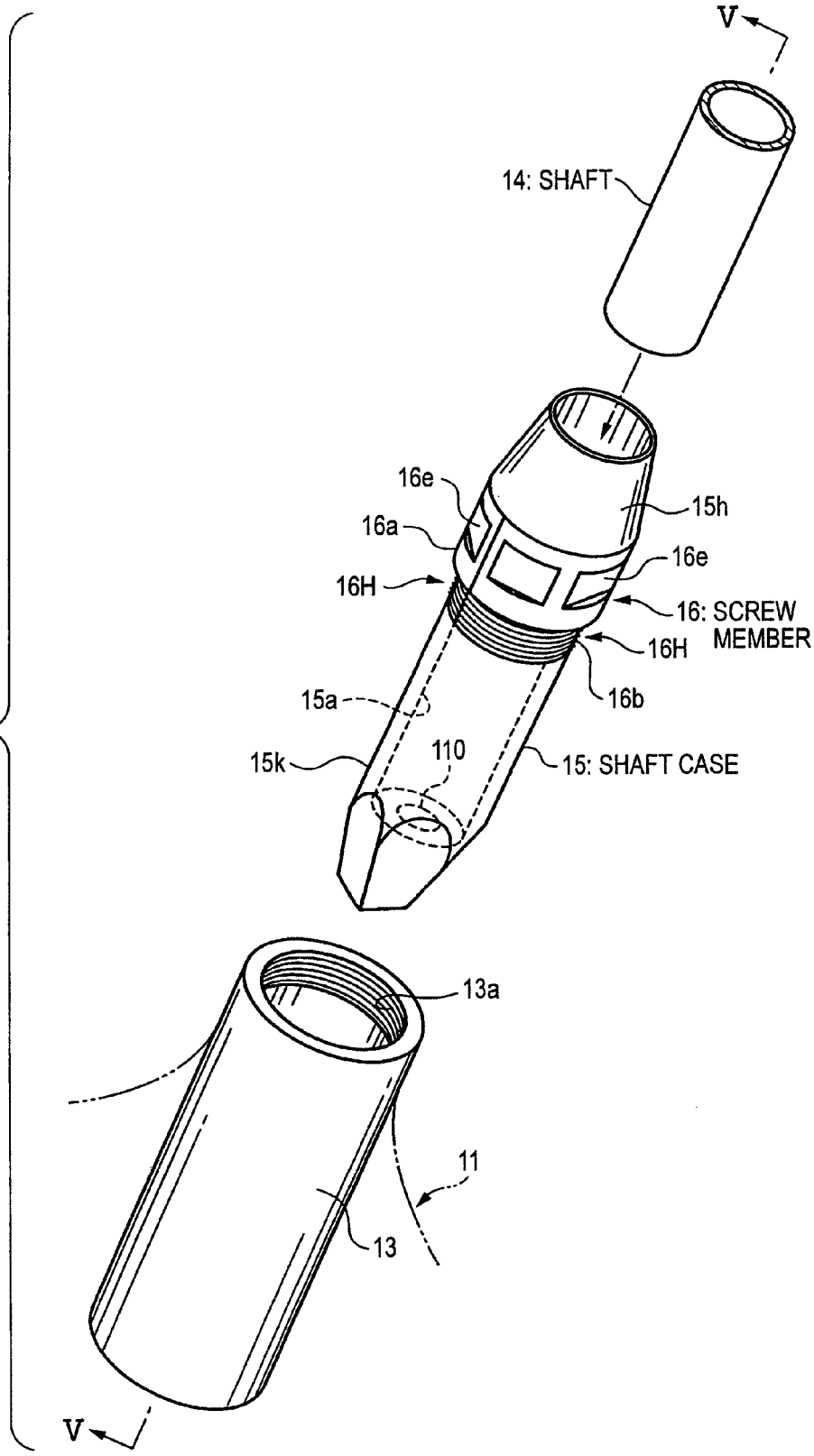
FIG. 16 is a perspective view showing methods of attaching and replacing a shaft.
Figure 17:
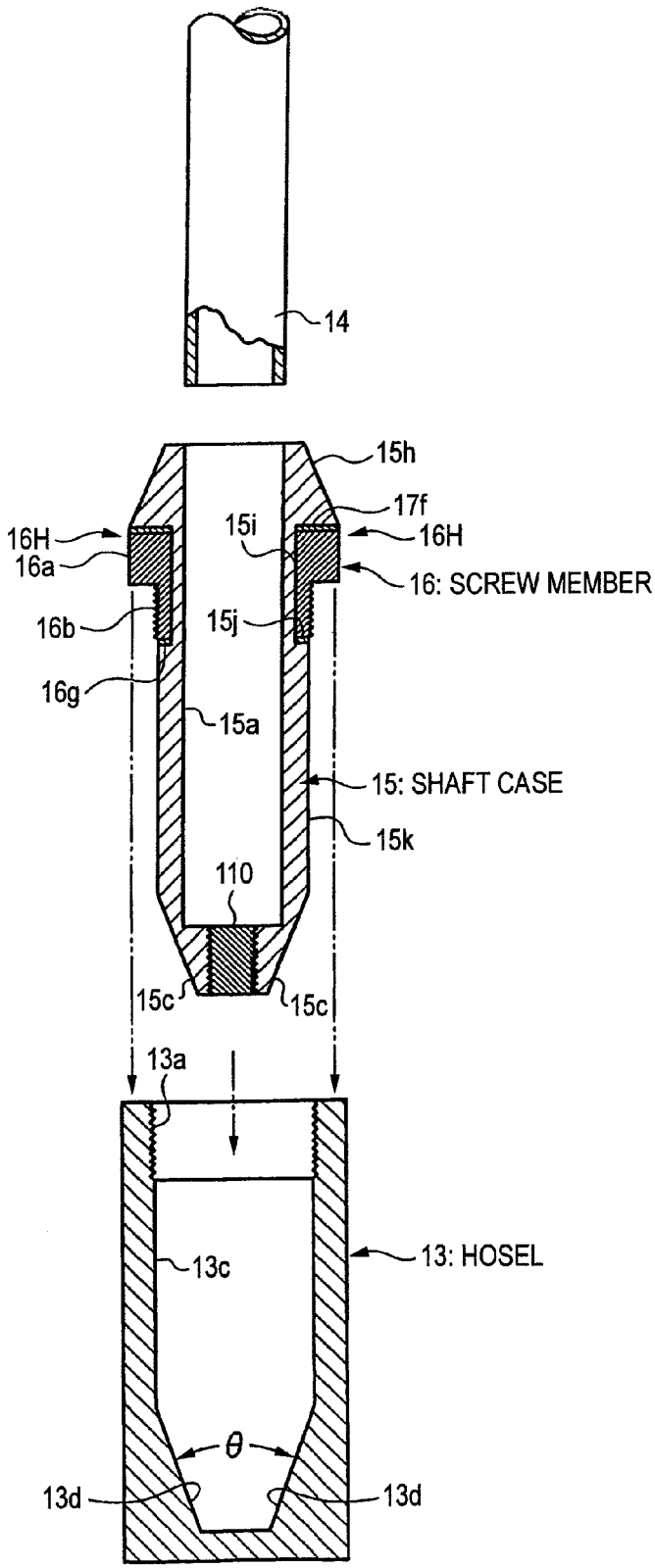
FIG. 17 is a cross-sectional view taken along the V-V line in FIG. 16.

As shown in FIGS. 15 to 17, the hosel 13 has a substantially cylindrical shape which is obtained by piercing a hole from the upper end to the lower end in the axial center line direction.

A female screw 13*a* is provided in the inner circumferential surface on the entrance side of the hole, that is, the upper end side of the hosel. According to this embodiment, this female screw 13*a* is a reverse screw, and a male screw 16*b* of the screw member 16, which will be described later, to be screwed into this female screw 13*a* is also a reverse screw.

A stepped surface 13*b* is provided in the diameter-reduced direction subsequently to the female screw 13*a*, the side further to the inside than this stepped surface 13*b* forms a cylindrical portion 13*c*. The side further to the inside than this cylindrical portion 13*c* is provided with two pairs of slopes 13*d* obliquely intersecting with the axial center of the hosel 13, and the hole bottom portion has a truncated square pyramid shape. The slopes 13*d* and 13*d* which face each other are symmetrically positioned while interposing the axial center of the hosel 13. The distance between the slopes 13*d* and 13*d* which face each other, that is, the distance in the direction perpendicular to the hosel axial center line becomes smaller as it approaches the lower end side of the hosel. The intersecting angle θ (FIG. 17) between the slopes 13*d* and 13*d* which face each other preferably ranges from 10 to 30° and particularly from about 15 to 20°.

Figure 18:
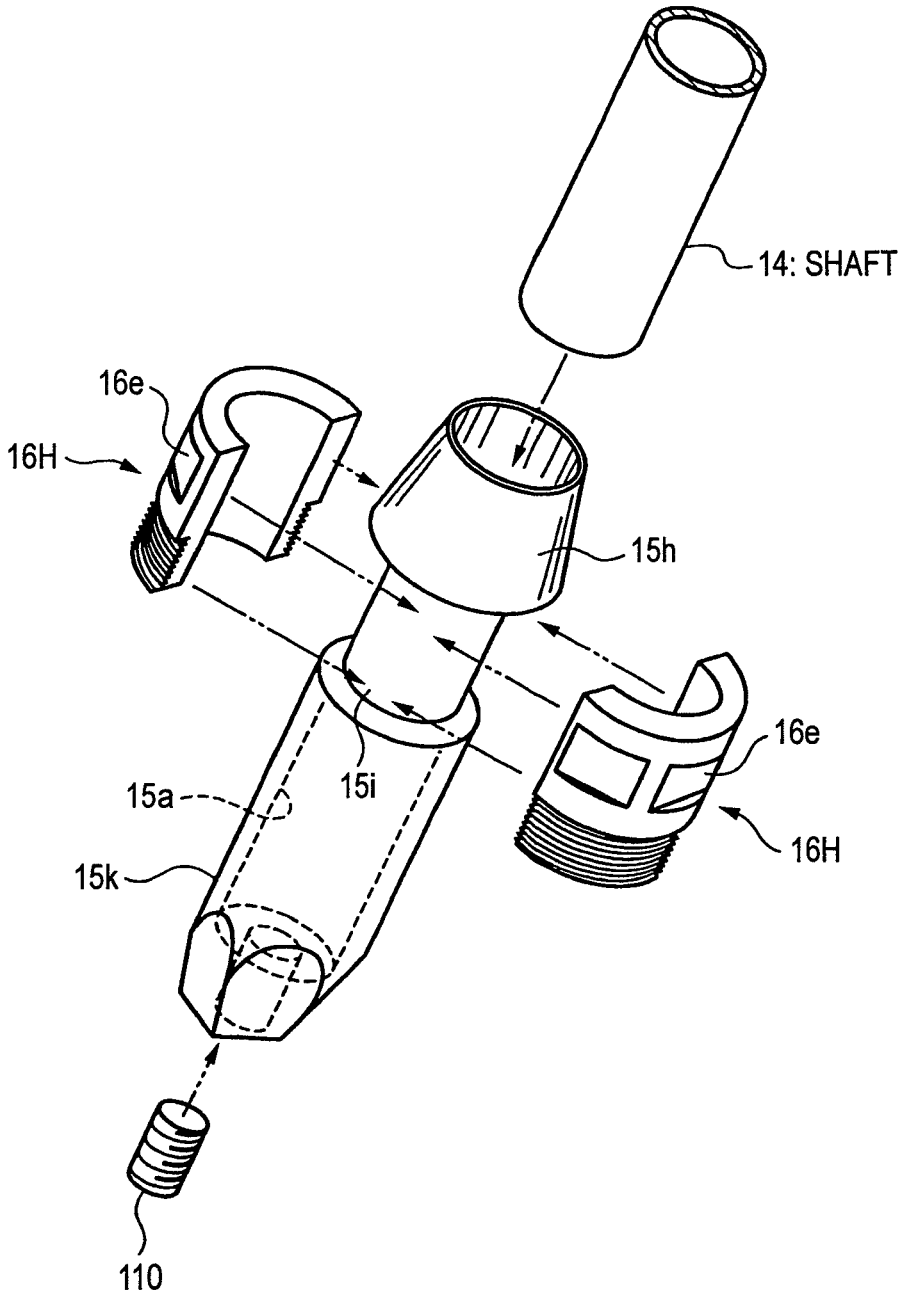
FIG. 18 is an exploded perspective view of a hosel, a shaft case, and a screw member.

As shown in FIGS. 15 and 18, the shaft case 15 is a substantially cylindrical member with a slightly smaller diameter than the cylindrical portion 3*c* of the hosel 13 and is provided with a hole 15*a* from the upper end side to the lower end side for inserting the shaft 14. The length of the shaft case 15 is preferably not less than 30 mm, from 40 to 60 mm, for example, and particularly from about 45 to 55 mm. It is preferable that the shaft case 15 protrudes from the hosel 13 by 10 to 30 mm, particularly by about 15 to 20 mm in the state of being inserted into and fixed to the hosel 3.

An enlarged diameter portion 15*h* having an outer circumferential surface with a tapered shape in which the diameter becomes smaller as it approaches the upper side is integrally provided on the upper end of the shaft case 15. The lower surface, that is, the upper stepped surface of the enlarged diameter portion 15*h* is superimposed on the upper surface of the screw member 16 via a space 17*f*.

The lower side part of the enlarged diameter portion 15*h* in the shaft case 15 forms a small diameter portion 15*i*. The screw member 16 is rotatably fitted onto this small diameter portion 15*i*. The lower side than the small diameter portion 15*i* of the shaft case 15 forms a large diameter portion 15*k* with a larger diameter than the small diameter portion 15*i*. The lower end surface of the screw member 16 is in contact with the stepped surface (lower stepped surface) 15*j* between this small diameter portion 15*i* and the large diameter portion 15*k* via the spacer 16*g*. In the same manner as in the screw member 16, a male screw 16*b* is provided on the outer circumferential surface of the lower half of the screw member 16.

A female screw opening is provided so as to penetrate from the inside bottom surface of the hole 15*a* to the lower end surface of the shaft case 15, and a weight material 110 is screwed into this female screw opening.

The depth of the hole 5*a* preferably ranges from 20 to 50 mm, particularly from 25 to 40 mm.

Two pairs of slopes 15*c* are provided on the outer surface of the shaft case 15 on the lower end side so as to form a truncated square pyramid shape. The slopes 15*c* and 15*c* facing each other are symmetrically provided while interposing the axial center line of the shaft case 15. The distance between the slopes 15*c* and 15*c* facing each other, that is, the interval in the direction perpendicular to the axial center line of the shaft case 15 decreases as it approaches the lower end side of the shaft case. The intersecting angle between the slopes 15*c* and 15*c* facing each other is the same as the intersecting angle θ between the slopes 13*d* and 13*d* of the hosel 13. The size of the slope 15*c* of the shaft case1 5 may be the same as that of the slope 13*d* of the hosel 13 and may be slightly smaller when an elastic body is interposed.

Although not shown in the drawings, a configuration is also applicable in which a chamfer with an angle of about 20 to 45° is formed in the inner circumferential edge of the shaft case 15 on the upper end side in order to make it easier to insert the shaft 14.

The screw member 16 has a substantially ring shape when two half-split screw members 16H as the split screw members are assembled. The screw member 16 has a configuration in which the lower half portion has a smaller diameter as compared with the upper half portion 16*a*, and a male screw 16*b* is carved on the outer circumferential surface of the lower half portion. On the outer circumferential surface of the upper half portion 16*a* on the upper end side, six plane portions 16*e* to be held by a tool are provided and form a nut shape. A tool holding concave portion or convex portion may be provided instead of the plane portions 16*e*.

The male screw 16*b* of the lower half portion of the screw member 16 has a diameter with which the male screw 16*b* is screwed into the female screw 13*a* of the hosel 13. The screw member 16 includes an opening penetrating in the axial center line direction. The diameter of this opening is very slightly larger than the diameter of the small diameter portion 5*i* of the shaft case 15, and the screw member 16 is rotatably fitted onto the small diameter portion 15*i*.

The half-split screw member 16H has a shape which is obtained by splitting this screw member 16 into two bodies along the surface including the axial center line.

As described above, ring-shaped spacers (thin spacers made of elastic bodies such as rubber, elastomer, or the like) 16*f* and 16*g* are interposed between the lower end surface of the upper half portion 6*a* of this screw member 16 and the upper end surface of the hosel 13 and between the lower end surface of the lower half portion 16*b* and the stepped surface 15*j*. In addition, a ring-shaped spacer 17*f* is interposed between the upper end surface of the screw member 16 and the enlarged diameter portion 15*h*.

When a golf club is assembled, the leading end of the shaft 14 is inserted into the shaft case 15 and bonded with an adhesive as shown in FIGS. 16 and 17. Preferably, the outer circumferential surface of the leading end portion of the shaft 14 is coated with this adhesive, and the shaft 14 is inserted up to the furthest portion of the hole 15*a* of the shaft case 15. In addition, since the air within the hole 15*a* is removed if the weight material 110 is detached when the shaft 14 is inserted, the shaft 14 can be easily inserted.

The half-split screw members 16H and 16H are engaged with the small diameter portion 15*i* of the shaft case 15 of the shaft case and shaft connected body, in which the shaft 14 and the shaft case1 5 are bonded, as shown in FIG. 18, the shaft case and shaft connected body is then inserted into the hosel 13 of the head 11 as shown in FIGS. 16 and 17, and the sole 15*c* and the slope 13*d* are superimposed. Thereafter, the male screw 6*b* of the screw member 16 is inserted into the female screw 13*a* of the hosel 13.

Thus, the lower end surface of the screw member 16 presses the stepped surface 15*j* of the shaft case 15, the slope 15*c* of the shaft case 15 is pressed onto the slope 13*d* of the hosel 13, and the shaft case 15 is fixed to the hosel 13 as shown in FIG. 15. The shaft case 15 and the shaft 14 are strongly adhered with the adhesive, and therefore, a golf club in which the shaft 14 and the head 11 are integrally provided is completed.

When the shaft case 15 is pulled out from this golf club, the screw member 16 is rotated in the loosening direction. Since the male screw 16*b* of this screw member 16 is screwed into the female screw 13*a* of the hosel 13, the screw member 16 moves upward (advances by screwing) and presses up the enlarged diameter portion 15*h* if the screw member 16 is rotated in the loosening direction, and the shaft case 15 moves upward. With such a configuration, the shaft case 15 can be easily detached since it moves to the upper direction in which the shaft case 15 is separated from the hosel 13.

In this embodiment, the screw member 16 is fitted onto the shaft case 15 and screwed into the hosel 13, and the screw member 16 does not contact with the shaft 14 when rotated. Accordingly, it is possible to prevent the shaft 14 from being damaged.

According to this golf club, since the shaft case 15 with the shaft 14 is inserted into the hosel 13 and fixed by the screw member 16, high attachment strength and rigidity between the shaft 14 and the shaft case 15 can be achieved.

According to the head 11 of this golf club, it is possible to adjust the balance and the weight by replacing the screw member 16 or the weight material 110 with the ones having different specific gravities or by detaching the weight material 110. It is possible to finely adjust the balance and the weight of the head by the weight material 110 by preparing a weight material 110 which is lighter than the screw material 16.

When the shaft of the golf club is to be replaced, the same shaft case as the above-mentioned shaft case 15 is bonded to a new shaft, with which the existing shaft is to be replaced, in advance with the adhesive.

The screw member 16 of the existing golf club is detached, and the old shaft 14, the old shaft case 15, a top member 17, and the screw member 16 are detached from the head 11 together. Subsequently, a new shaft with a shaft case, a top member, and a screw member (shaft case and shaft connected body) is inserted into the head 11 and fixed by the screw member 16.

As described above, it is possible to perform attachment and replacement of the shaft very easily and rapidly. Conventionally, it took several hours to about a day to replace the shaft since the hosel portion of the existing golf club was heated to destroy the composition of the adhesive hardener, the shaft was pulled out, and a new shaft was then bonded with adhesive. However, it is possible to replace the shaft in several minutes by attaching the shaft case 15 to the new shaft with adhesive in advance in the embodiment. Accordingly, it is possible to implement a usage style in which different shafts are sequentially attached to the same head main body for trial shots by preparing the shafts of various specifications, to each of which the shaft case is attached.

Since the inner surface of the further side in the hosel hole 13 and the outer surface of the shaft case 15 on the lower end side are respectively made to have a non-circular cross-sectional shape (the cross-section perpendicular to the axial center line has a non-circular shape) by providing the slopes 13*d* and 15*c*, and these slopes 13*d* and 15*c* are engaged with each other, less slipping occurs, and the rotation of the shaft 14 about a direction around the axial center of the shaft is prevented. That is, high fixing rigidity of the shaft 14 in the torque direction can be achieved.

In addition, the shaft case 15 can be easily inserted into the hosel 13 since the leading end side of the shaft case 15 is made to have a tapered shape by providing two pairs of slopes 15*c*.

It is preferable that the hosel, the shaft case, and the screw member are made of metal, particularly, aluminum, titanium, or an alloy thereof. The hosel 13 is preferably made of a material with a specific gravity equivalent to or lower than that of the head main body, and titanium alloy, aluminum, aluminum alloy, magnesium alloy, FRP, synthetic resin or the like may be used, for example. As the material of the weight material 110, titanium alloy, aluminum, aluminum alloy, magnesium alloy, FRP, synthetic resin, or the like can be used.

Although the material of the head is not particularly limited, titanium alloy, aluminum alloy, stainless, or the like may be used, for example, in the case of a wood type golf club head.

Although the golf club head is a wood type in the above embodiment, the present invention can also be applied to any type of golf club head including a utility type, an iron type, a putter, and the like.

In the case of a hollow type golf club head shown in the drawings, the weight on the heel side is heavier as compared with a general golf club head since the hosel 13, the hosel placement portion 12*g*, the shaft case 15, and the screw member 16 are provided. Accordingly, it is preferable to configure the toe side or the back portion to be thicker or provide a weight on the toe side in order to keep a good balance for the golf club head.

Figure 19:
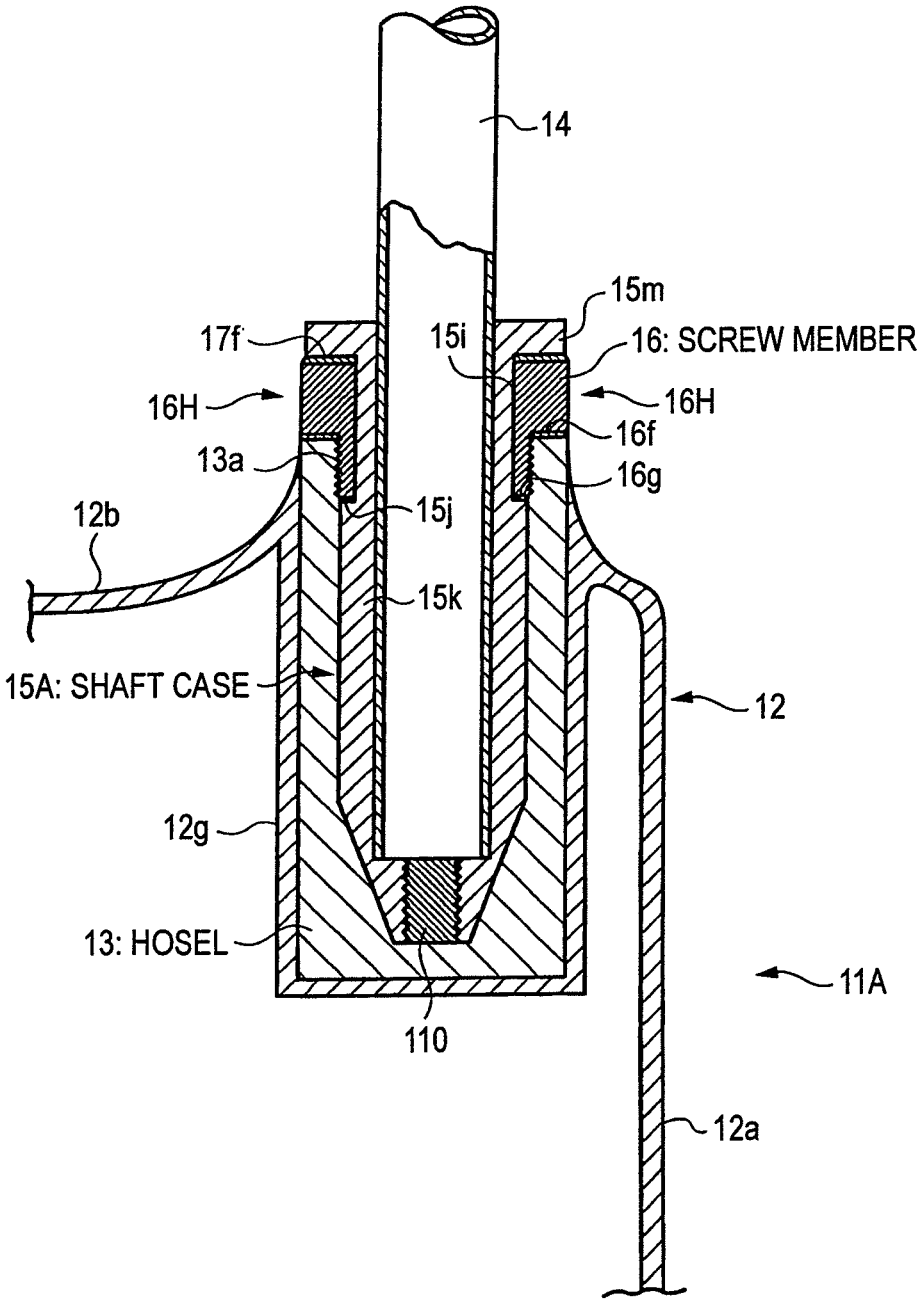
FIG. 19 is a cross-sectional view showing another embodiment.
Figure 20:
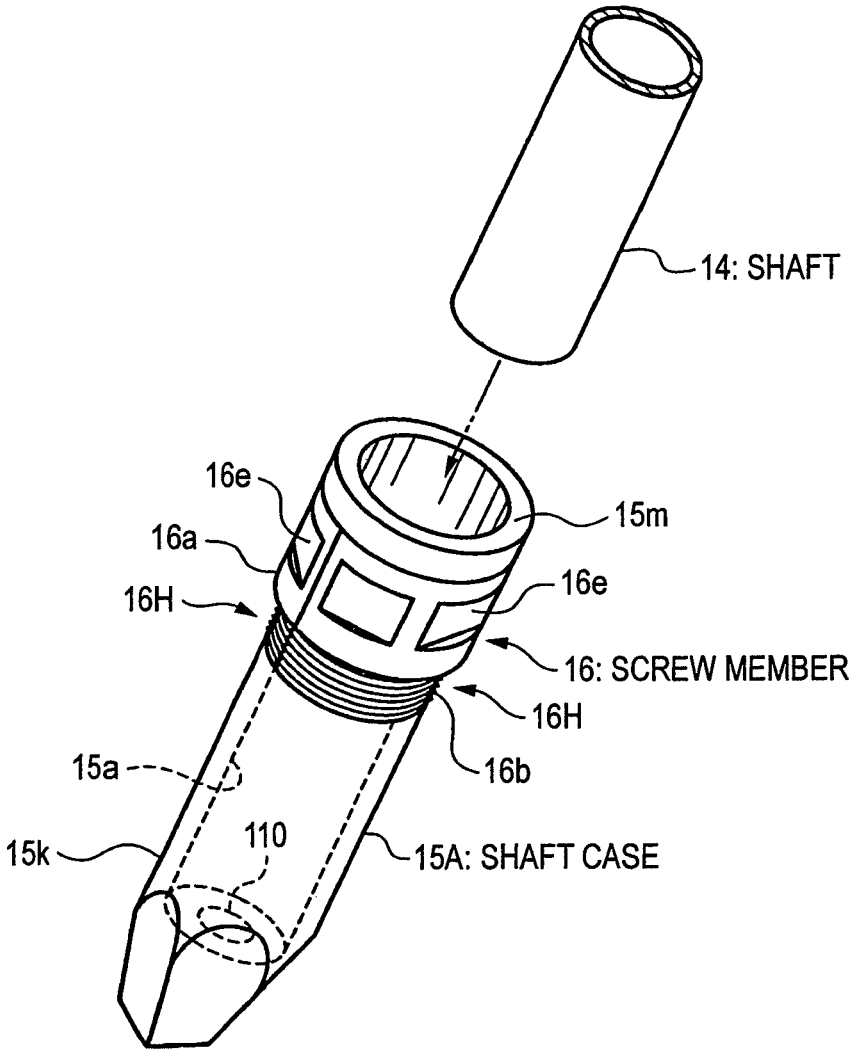
FIG. 20 is an exploded perspective view of FIG. 19.

FIG. 19 is a cross-sectional view of a golf club head 11A on the heel side according to another embodiment, and FIG. 20 is a perspective view of a shaft case 5A and the screw member 16.

Although the enlarged diameter portion 15*h* in the golf club shown in FIGS. 13 to 18 has a tapered shape, the shaft case 15A of the golf club 11A shown in FIGS. 19 and 20 is provided with an enlarged diameter portion 15*m* having a flat flange shape. The other configurations in FIGS. 19 and 20 are the same as those in FIGS. 13 to 18, and the same reference numeral represent the same parts.

Figure 21:
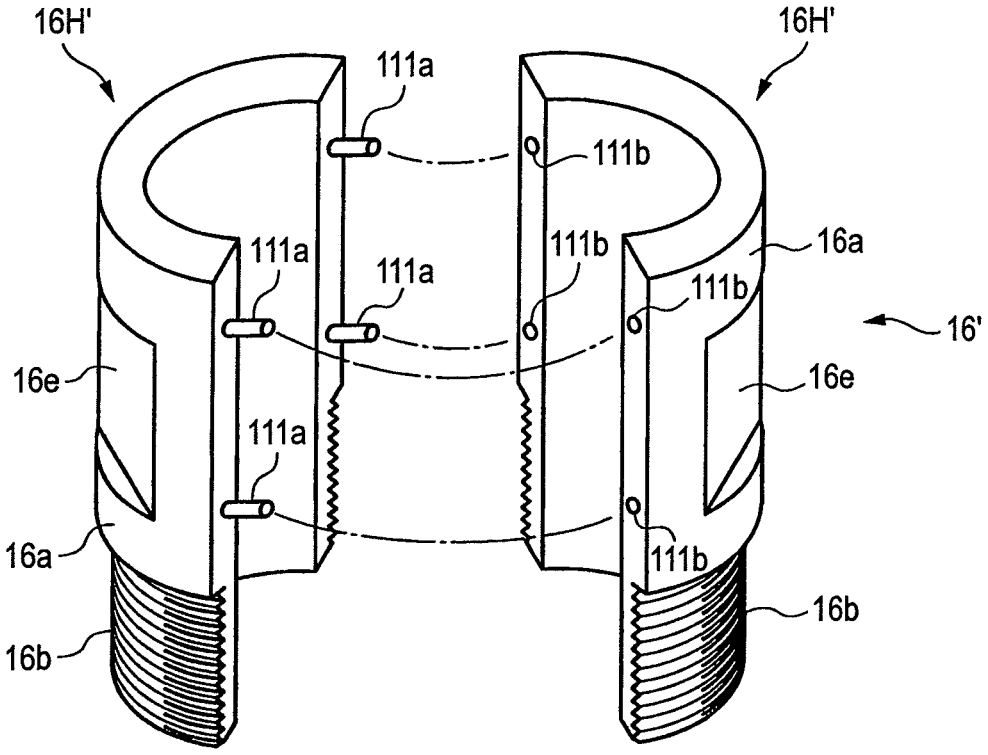
FIG. 21 is an exploded perspective view of half-split screw members used in an embodiment.

According to the present invention, a configuration is applicable in which engaging means is provided between the half-split screw members as shown in FIGS. 21 to 23 in order to enhance the handling property.

In FIGS. 21A and 21B, pins 111*a* are provided on the end surface of one half-split screw member 16H' in the tube axis direction, and concave holes 111*b* are provided on the end surface of the other half-split screw member 16H' in the tube axis direction. The half-split screw members 16H' are engaged with each other such that the pins 111*a* are inserted into the concave holes 111*b*, and thereby forming a cylindrical screw member 16'.

Figure 22A:
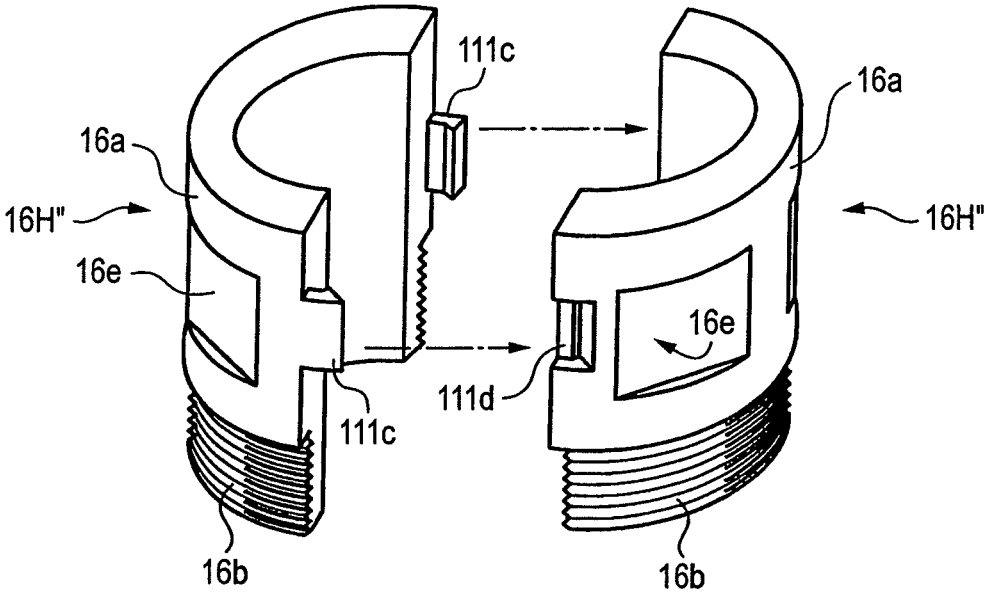
FIG. 22A is an exploded perspective view of half-split screw members used in an embodiment.
Figure 22B:
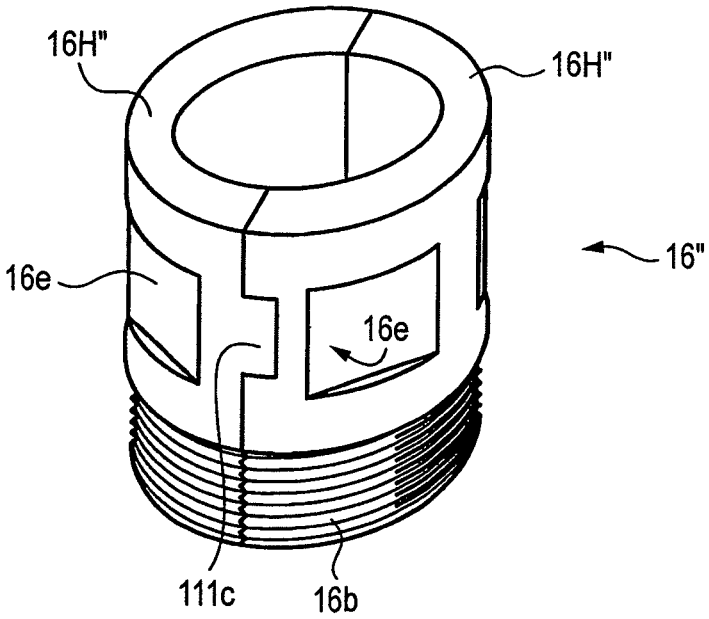
FIG. 22B is a perspective view of these screw members.

In FIGS. 22A and 22B, claw portions 111*c* are provided on the end surface of one half-split screw member 16H" in the tube axis direction, and locking groove portions 111*d* are provided on the end surface of the other half-split screw member 16H" in the tube axis direction. The half-split screw members 16H" are engaged with each other such that the claw portions 111*c* are locked by the locking groove portions 111*d*, and thereby forming a cylindrical screw member 16".

Figure 23A:
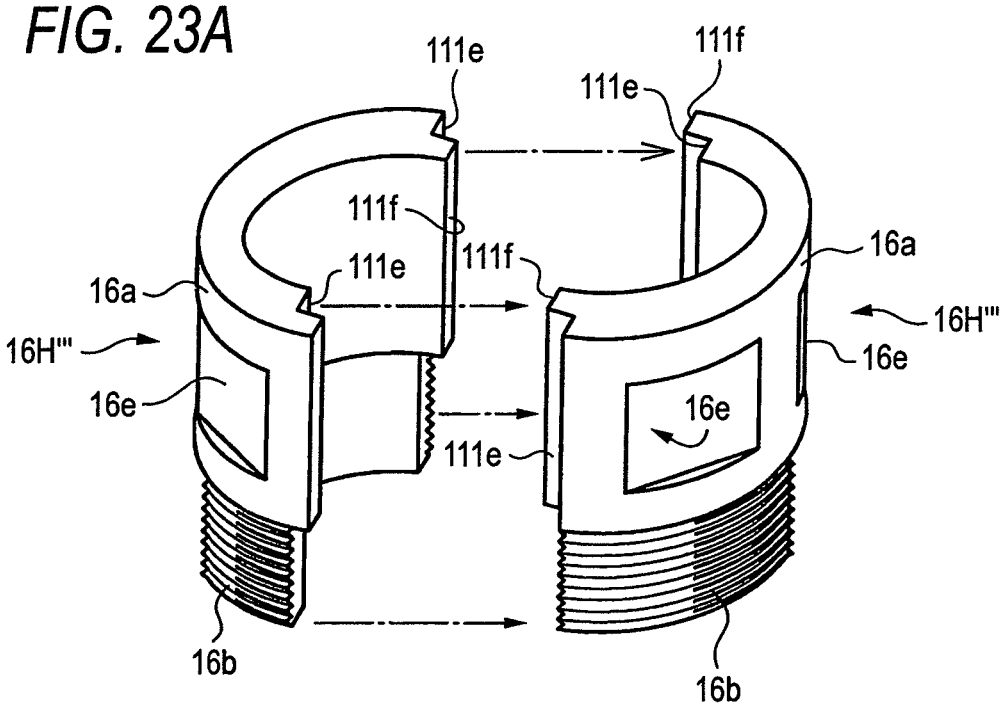
FIG. 23A is an exploded perspective view of half-split screw members used in an embodiment.
Figure 23B:
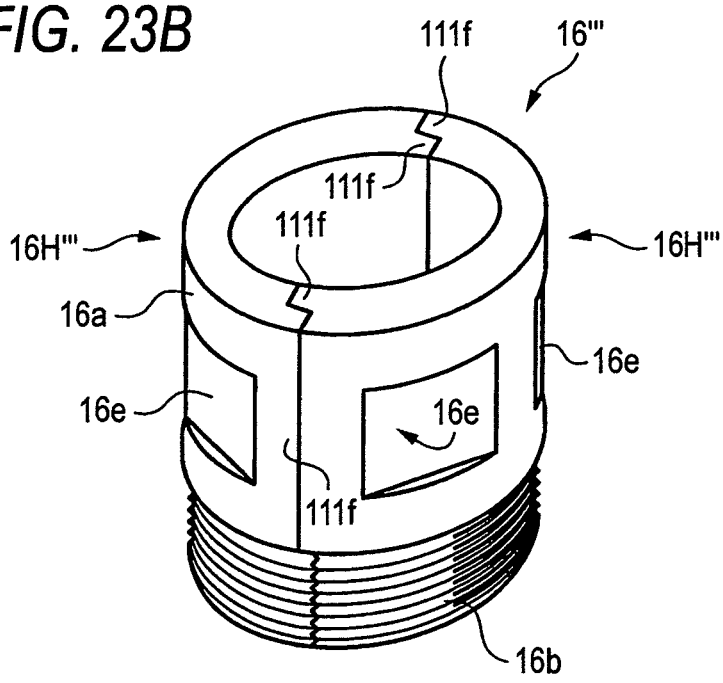
FIG. 23B is a perspective view of these screw members.

In FIGS. 23A and 23B, a convex ridge 111*f* is provided on the outer circumferential side and a concave ridge 111*e* is provided on the inner circumferential side on one end surface from among the two end surfaces of a half-split screw member 16'" in the tube axis direction. A concave ridge 111*e* is provided on the outer circumferential side and a convex ridge 111*f* is provided on the inner circumferential side on the other end surface. Both the convex ridge 111*f* and the concave ridge 111*e* extend from one end to the other end of the half-split screw members 16H'" in the tube axial center direction. The half-split screw members 16H'" are engaged with each other such that the convex ridges 111*f* of one half-split screw member 16H'" are engaged with the concave ridge 111*e* of the other half-split screw member 16H'", and thereby forming a cylindrical screw member 16'".

Any of the above embodiments is just an example of the present invention, and other configurations than those shown in the drawings may be applicable. For example, a configuration is applicable in which the half-split screw members are made to have magnetic properties and the cylindrical screw member is constituted by combining the half-split screw members by magnetic force.

What is claimed is:

1. A golf club comprising:

a hosel of a head to which a leading end of a shaft is attached;

a weight material for adjusting weight; and a communication opening which communicates the lower end portion of the hosel hole with an inside of the head, wherein the weight material is detachably screwed into the communication opening, wherein:

the leading end of the shaft is inserted into and bonded to a shaft inserting hole of a substantially cylindrical shaft case including the shaft inserting hole;

the shaft case is inserted into the hosel hole;

an axial center of the shaft inserting hole is obliquely directed with respect to an axial center of the hosel hole;

the shaft case is fixed to the hosel with a ring-shaped screw member which fits onto the shaft case and is detachably screwed into the hosel on the upper end side;

the screw member is arranged in an outer circumference of the shaft case in the non-contact state with respect to the shaft; and at least a part of an inner circumferential surface of the hosel hole and at least a part of the outer circumferential surface of the shaft case respectively have a sectional shape in the direction perpendicular to the axial center line, which is a multiangular shape with 3 or more sides.

2. The golf club according to claim 1, wherein:

a convex portion is provided on the outer circumferential surface of the shaft case in the middle of its axial center line direction;

a female screw is carved on the inner circumferential surface of the hosel hole on the upper end side;

a male screw is provided on the outer circumferential surface of the screw member;

the screw member is fixed to the hosel hole by screwing the male screw into the female screw of the hosel hole; and the shaft case is fixed by pressing the convex portion downward by the lower end surface of the screw member.

3. The golf club according to claim 1, wherein an elastic body is interposed on the lower side of the screw member.

4. The golf club according to claim 1, wherein the shaft is inserted into the shaft inserting hole of the shaft case and bonded with adhesive.

5. The golf club according to claim 1, wherein a lower end side of the shaft case has a tapered multiangular sectional shape.

6. The golf club according to claim 1, wherein the elastic body is interposed between a lower end side of the shaft case and an inner surface of the hosel hole.

* * * * *